US007445138B2

(12) United States Patent
Chu

(10) Patent No.: US 7,445,138 B2
(45) Date of Patent: Nov. 4, 2008

(54) PASSIVE EXOSKELETON

(75) Inventor: Conrad Chu, 410-A Carlton Ave., Piscataway, NJ (US) 08954

(73) Assignee: Conrad Chu, Piscataway, NJ (US)

( * ) Notice: Subject to any disclaimer, the term of this patent is extended or adjusted under 35 U.S.C. 154(b) by 678 days.

(21) Appl. No.: 11/031,425

(22) Filed: Jan. 6, 2005

(65) Prior Publication Data

US 2005/0258210 A1 Nov. 24, 2005

Related U.S. Application Data

(63) Continuation-in-part of application No. 10/850,202, filed on May 19, 2004.

(51) Int. Cl.
*A63B 25/00* (2006.01)

(52) U.S. Cl. ..... 224/637; 482/75

(58) Field of Classification Search ..... 224/637, 224/661, 662, 904, 222, 671, 674, 679, 680; 135/67; 482/75, 51, 52, 70; 280/1.181
See application file for complete search history.

(56) References Cited

U.S. PATENT DOCUMENTS

| | | | | | |
|---|---|---|---|---|---|
| 406,328 | A | * | 7/1889 | Yagn | 482/77 |
| 420,178 | A | * | 1/1890 | Yagn | 482/51 |
| 420,179 | A | * | 1/1890 | Yagn | 482/51 |
| 440,684 | A | * | 11/1890 | Yagn | 482/51 |
| 807,908 | A | * | 12/1905 | Bradstreet | 482/51 |
| 979,243 | A | * | 12/1910 | Anderson | 482/51 |
| 1,308,675 | A | * | 7/1919 | Kelley | 482/51 |
| 2,010,482 | A | * | 8/1935 | Cobb | 623/31 |
| 2,351,145 | A | * | 6/1944 | Pearson | 623/28 |
| 3,346,882 | A | * | 10/1967 | Wilhoyte | 623/28 |
| 3,902,199 | A | * | 9/1975 | Emmert | 623/28 |
| 4,872,665 | A | * | 10/1989 | Chareire | 482/51 |
| 4,969,452 | A | * | 11/1990 | Petrofsky et al. | 602/16 |
| 5,060,640 | A | * | 10/1991 | Rasmusson | 602/16 |
| 5,568,887 | A | * | 10/1996 | Gollihue et al. | 224/661 |
| 5,588,456 | A | * | 12/1996 | Hart | 135/67 |
| 5,645,515 | A | * | 7/1997 | Armstrong et al. | 482/75 |
| 5,658,242 | A | * | 8/1997 | McKay et al. | 602/16 |

(Continued)

OTHER PUBLICATIONS

Chu, Andrew; Design Overview of 1st Generation Exoskeleton; Apr. 3, 2003; Master of Science Thesis Mechanical Engineering at the University of California, Berkeley; pp. 1-62.*

*Primary Examiner*—Nathan J Newhouse
*Assistant Examiner*—Lester L Vanterpool
(74) *Attorney, Agent, or Firm*—Tope-McKay & Associates

(57) ABSTRACT

A load bearing apparatus is presented in the form of a passive exoskeleton whereby a load may be placed on the passive exoskeleton and thereby weight of the load from the passive exoskeleton is transferred to a ground surface. The passive exoskeleton is made of a rigid body member for attaching proximate a portion of a user's body; a sliding rod attached with the body member; a ground surface engage-able foot analog attached with the sliding rod; a rocker pivotally attached with the body member; a load pin attached with the sliding rod and operably attached with the rocker; and a bias block attached with the body member for engaging with the rocker. As a user walks, the bias block pivots the rocker to aid the load pin in transferring weight to the rocker and thereafter through the sliding rod to the foot analog and ground surface.

46 Claims, 43 Drawing Sheets

U.S. PATENT DOCUMENTS 6,517,586 B2 * 2/2003 Lin ..... 623/28
6,648,803 B1 * 11/2003 Jay ..... 482/76
6,676,707 B2 * 1/2004 Yih et al. ..... 623/24
7,108,640 B2 * 9/2006 Emmert ..... 482/75
7,278,979 B2 * 10/2007 Shimada et al. ..... 602/16

* cited by examiner

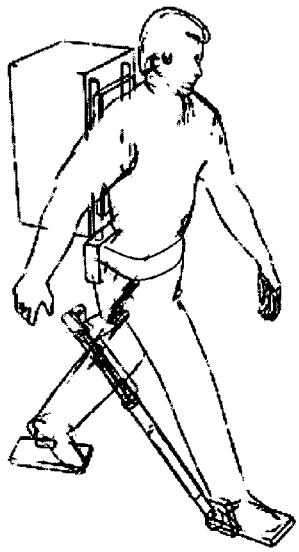
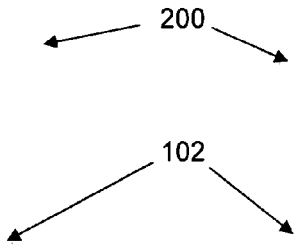
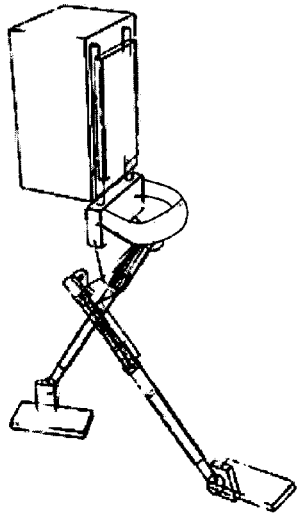
FIGURE 13A
FIGURE 13B

PASSIVE EXOSKELETON

PRIORITY CLAIM

This application is a Continuation-In-Part application, claiming the benefit of priority to non-provisional application Ser. No. 10/850,202, filed in the United States on May 19, 2004, and titled "Passive Exoskeleton."

BACKGROUND OF INVENTION (1) Field of Invention

The present invention relates to a load-bearing apparatus, and more particularly to a passive exoskeleton onto which a load may be placed, with the weight of the load transferred from the passive exoskeleton to a ground surface, causing the passive exoskeleton to support at least a portion of the load.

(2) Background of Invention

Load bearing devices have long been known in prior art. For example, backpacks with frames have long been employed to reduce a load carried by an individual's shoulders. Although the backpack functions to distribute the load, the weight of the load is transferred to the individual's hips, forcing the individual to ultimately bear the burden of the load. Because of the necessity to bear the burden of the load, the amount of weight an individual may carry using a traditional backpack is limited.

Other examples of load-bearing devices include orthopedic devices such as canes, crutches, and walkers. Although orthopedic devices transfer the load to the ground, they generally are designed under an assumption that the user must be able to stand and carry his/her own weight. Many orthopedic devices require the user's upper torso to be continuously used and such devices generally are not useful when upper limbs must remain free and unoccupied.

Another example of an orthopedic device is disclosed in U.S. Pat. No. 6,015,076, issued to Pennington ("the Pennington patent"). The Pennington patent discloses a hip belt which reduces fatigue by bridging across muscles and nerves in the gluteal region. A drawback of devices made according to this particular prior art is that all of the weight is still carried by the individual's skeletal and muscular system.

In an effort to reduce the load placed on the user's skeletal and muscular system, powered exoskeletons have been proposed. Powered exoskeletons mimic the function of body joints by using actuators or artificial muscles. The actuators required for these exoskeleton concepts consume significant power, supplies for which are either difficult to produce or are currently unavailable. Additionally, the compact actuator (artificial muscle) technology has currently not progressed enough to make practical devices. As such, the development of a powered exoskeleton requires further developments in a variety of fields, including actuation, artificial muscles, and advanced energy storage. Given the current state of these technologies, powered exoskeletons may not be realized for decades to come.

In an effort to provide an exoskeleton without a power system, the applicant of the present invention previously devised a passive exoskeleton. The passive exoskeleton comprises a rigid body member for attaching proximate a portion of a user's body, a rocker pivotally attached with the body member, a sliding rod attached with the rocker, and a ground surface engage-able foot analog attached with the sliding rod. The rocker has both a load channel and a travel channel, while a load pin attached with the sliding rod travels between the load and travel channels as a user walks. As a user places a load on the body member and walks forward, weight of the load is transferred from the body member, through the rocker's load channel, onto the load pin and its sliding rod. Thereafter, weight from the load passes into the foot analog, causing the passive exoskeleton to support at least a portion of the load. Rocker stops are attached with the body member, such that when a user is in a full stride gait, the rocker continues its motion until it hits the rocker stops at the limit of its travel. The rocker stops aid the load pin in transferring between the load and travel channels at the appropriate times during the user's forward gait. Although functional for forward motion, the problem with such a configuration is that it does not work as well for backwards (i.e., reverse) motion. With a single load channel, the rocker stops alone are not sufficient to aid in transferring the load pin between the load and travel channels when a user is traveling backwards.

Thus, it can be appreciated that there exists a continuing need for a passive exoskeleton that permits a user to walk both forward and backwards, such that in either direction, the load pin travels between the load and travel channels at the appropriate times during a user's gait. The present invention substantially fulfills this need.

SUMMARY OF INVENTION

The present invention relates to a load bearing apparatus, and more particularly, to a passive exoskeleton whereby a load may be placed on the passive exoskeleton and thereby transfer weight of the load from the passive exoskeleton to a ground surface.

The passive exoskeleton comprises a body member for attaching proximate a portion of a user's body; a sliding rod attached with the body member; a ground surface engage-able foot analog attached with the sliding rod; a rocker pivotally attached with the body member; a load pin attached with the sliding rod; and a bias block attached with the body member.

The rocker has a travel channel and a load channel incorporated therein. The travel channel is an elongated channel oriented directionally from proximate the body member to the ground surface. The load channel is formed as an elongated channel and positioned such that an angle between the load channel and the travel channel is less than ninety degrees. The rocker also includes a top component.

A load pin is attached with the sliding rod and operably attached with the rocker through both the travel channel and the load channel. The load pin is formed such that as a user walks and shifts from a swing phase to a stance phase, the load is transferred from the body member to the rocker, the shift causing the load pin to travel between the travel channel and the load channel.

A bias block is attached with the body member for engaging with the top component of the rocker. Both the bias block and the top component of the rocker are formed in such a manner such that as a user walks backwards and shifts between the swing phase and stance phase, the top component of the rocker passes a point of equilibrium where the bias block turns the rocker to aid the load pin in transferring between the load channel and travel channel, thereby shifting the load from the rocker onto the sliding rod and thereafter through the sliding rod to the foot analog and ultimately a ground surface, causing the passive exoskeleton to support at least a portion of the load.

In another aspect, the passive exoskeleton further comprises a pressure mechanism attached with the bias block for forcing the bias block against the top component of the rocker, thereby aiding the bias block in turning the rocker after the top component of the rocker passes the point of equilibrium. The pressure mechanism is selected from a group consisting of a spring and hydraulics.

The passive exoskeleton further comprises a neutral block attached with the passive exoskeleton. The neutral block is formed in such a manner that it is engage-able with the rocker to prevent the rocker from moving, such that when engaged with the rocker and when the load pin is in the travel channel, the load pin is maintained in the travel channel and is unable to transfer to the load channel, thereby causing the user to bear the full weight of the load.

In yet another aspect, the passive exoskeleton further comprises a front rocker stop and a rear rocker stop. The front rocker stop and the rear rocker stop are attached with the body member. Additionally, the rocker further comprises a top component for engaging with both the front and rear rocker stops. The top component and rocker stops are formed such that when a user is walking, the rocker travels from a forward position to a rear position, and when the rocker is in a forward position, the top component engages with the rear rocker stop, and when the rocker is in a rear position, the top component engages with the front rocker stop.

In another aspect, the sliding rod further comprises an alignment rod and a load rod. The alignment rod has a top portion, a bottom portion, and a length with an axis therethrough. The top portion of the alignment rod is pivotally attached with the body member. The load rod is in a fixed parallel alignment with the axis of the alignment rod. The load rod has a top part and a bottom part, where the load rod is connected with the alignment rod such that a length of the sliding rod is adjustable by sliding the top part of the load rod between the bottom portion and top portion of the alignment rod. Furthermore, the load pin is attached with the load road, whereby as a user walks and shifts from a swing phase to a stance phase, the load is transferred from the body member to the rocker. The shift causes the load pin to travel between the travel channel and the load channel, thereby shifting the load from the rocker onto the load pin and thereafter through the load rod and the foot analog to the ground surface.

In yet another aspect, the body member is rigid, allowing the passive exoskeleton to transfer weight from the body member and through the passive exoskeleton to the ground surface.

Additionally, the load rod further comprises an ankle joint attached with the bottom part of the load rod, where the ankle joint pivotally connects the load rod with the foot analog.

In another aspect, the rocker has a first side and a second side, and both the travel channel and the load channel are formed through the rocker from the first side to the second side.

Additionally, the present invention further comprises a foot connector attached with the foot analog, whereby a user may utilize the foot connector to securely attach the foot analog with the user's foot or shoe, thereby allowing the foot analog to maintain a position proximate the user's foot.

In yet another aspect, the present invention further comprises a body attachment attached with the body member. The body attachment is selected from a group consisting of a flexible harness, a belt, and suspenders. The body attachment is for attaching with a torso portion of a user, allowing the user to operate the exoskeleton and maintain the exoskeleton in a position proximate the user.

Additionally, the present invention further comprises a load frame attached with the body member, whereby a user may attach a load with the load frame and thereby transfer weight from the load, through the exoskeleton and to the ground surface.

Finally, it can be appreciated by one in the art that the present invention also comprises a kit and method for forming and supporting a load using the apparatus described herein.

BRIEF DESCRIPTION OF THE DRAWINGS

The nature of the passive exoskeleton described herein will be readily apparent with reference to the description below, taken in conjunction with the following drawings, in which:

FIG. 13A is an illustration of a perspective view of a passive exoskeleton attached with a user, where a right leg of a user is in an initial contact of a stance phase;

FIG. 13B is an illustration of the passive exoskeleton in the position shown in FIG. 13A, without the user;

DETAILED DESCRIPTION

Figure 1:
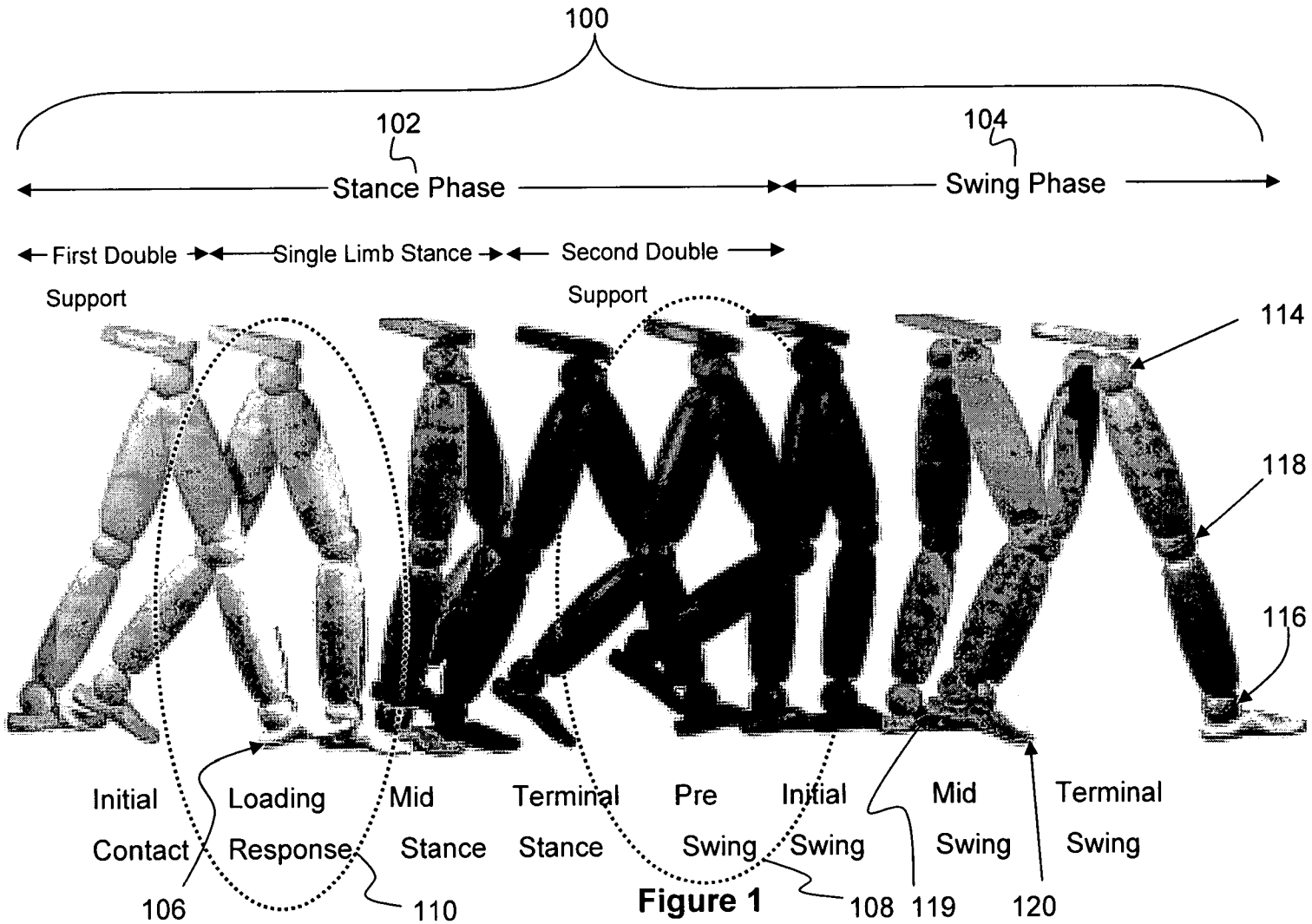
FIG. 1 is an illustration of gait kinematics, illustrating a stance phase and a swing phase of an individual's gait.

The present invention relates to a load bearing apparatus, and more particularly to a passive exoskeleton that permits a load to be placed on the passive exoskeleton for at least a portion of the weight of the load to be transferred directly from the passive exoskeleton to a ground surface, causing the passive exoskeleton to support at least a portion of the load.

The following description, taken in conjunction with the referenced drawings, is presented to enable one of ordinary skill in the art to make and use the invention. Various modifications will be readily apparent to those skilled in the art, and the general principles defined herein may be applied to a wide range of aspects. Thus, the present invention is not intended to be limited to the aspects presented, but is to be accorded the widest scope consistent with the principles and novel features disclosed herein. Furthermore, it should be noted that unless explicitly stated otherwise, the figures included herein are illustrated qualitatively and without any specific scale, and are intended to generally present the concept of the present invention.

In order to provide a clear frame of reference, first a glossary of terms used in the description and claims is given as a central resource for the reader. Next, a description of gait kinematics is provided to give an understanding of motion as applicable to the present invention. Third, a detailed description is provided to give specific details of the present invention. Finally, a description of the present invention during various motions is provided to further illustrate the utility of the present invention.

(1) Glossary

Before describing the specific details of the present invention, a central location is provided in which various terms used herein and in the claims are defined. The glossary provided is intended to provide the reader with a general understanding for the intended meaning of the terms, but is not intended to convey the entire scope of each term. Rather, the glossary is intended to supplement the rest of the specification in more clearly explaining the terms used.

Bias Block—The term "bias block" refers to a mechanism or device attached with a body member for engaging with a top component of a rocker, such that as a user walks backwards and shifts between the swing phase and stance phase, the top component of the rocker passes a point of equilibrium, with the bias block turning the rocker to aid the load pin in transferring between a load channel and a travel channel. The bias block is overridden when normal (i.e., forward) locomotion occurs.

Exoskeleton—The term "exoskeleton" refers to a load bearing apparatus for attaching with a user.

Foot-Analog—The term "foot-analog" refers to a structure or device that is similar to a human foot in that it is engageable with a ground surface and may used for transferring weight to the ground surface.

Gait Kinematics—The term "gait kinematics" refers to body mechanics associated with walking or stepping.

(2) Gait Kinematics

The present invention relates to a load-bearing passive exoskeleton. In order to better understand the invention, some introductory remarks are provided to help explain gait kinematics. As shown in FIG. 1, the gait cycle 100 can be divided into two phases: a stance phase 102 and a swing phase 104. As shown in FIG. 1, the stance phase 102 accounts for approximately sixty percent (60%) of the gait cycle 100 during walking. It starts at heel-strike (initial contact) 106 and ends at toe-off (pre-swing) 108. The swing phase 104 accounts for approximately 40% of the gait cycle 100 and is when the limb is not loaded. So, for example, when one limb is in a loading response 110, the other limb is in a pre-swing 108.

In order for the passive exoskeleton to function properly, two fundamental criteria should be met: (1) a rod (brace) should support a load during the stance phase 102, but not inhibit motion during the swing phase 104, and (2) the rod (brace) must allow a normal range of motion, while comfortably supporting a load.

There are a number of ways that such a structure could support a load. One possibility is to have a rigid rod that maintains a fixed distance between a hip 114 and an ankle 116. Since a user's knee 118 would be locked in this case (i.e., it doesn't bend), the user would be forced to walk unnaturally, with unbending knees. Although the rod could hold part of the weight of the load, such a device would be uncomfortable because of this "unbent knee" problem.

Another possibility would be to have two rods connected by a hinge joint at the knee 118. A problem with this, however, is that a hinge cannot support weight by itself. In this case, a user would need to use leg muscles acting at the knee 118 to prevent falling. Similarly, a hinged brace would require a muscle or actuator to mimic the function of the knee 118. Such a system, however, is not practical using current actuator technologies. Instead of adding complexity and requiring self-contained power to drive these actuators, the present invention pursues a different strategy, to create a simple device that requires no electrical power.

One possible passive solution would be to use a spring at the hinged knee joint. The spring could take up part of the load and act as the constant muscle for the knee joint. Adding a spring would allow some bending of the knee 118 and better gait kinematics. A problem with this approach, however, is that the system should carry the load during the stance phase 102, but not resist the leg force during the swing phase 104 (when the leg is swinging forward and is not supporting the weight). Otherwise, the benefit in having the device support the load during the stance phase 102 of the stride would be negated during the swing phase 104 of the stride. In this example, any time the knee 118 is bent, force must be exerted to compress the spring. After heel-strike 106, during the stance phase 102 of the gait cycle 100, a spring would be desirable because the weight of the load is used to compress the spring. However, after toe-off and during the swing phase 104, the spring is undesirable because the user must use considerable force to bend the knee 118 and bring up the heel 119 to allow the toe 120 to clear the ground during the swing phase 104. During the swing phase 104, the user would be "fighting the spring."

Another possible solution is to have one rigid rod between the hip 114 and ankle 116, but to allow the user's knee 118 to bend. The difficulty with this solution is that when the user's knee 118 bends, the distance between the hip 114 and ankle 116 varies. With a single rod, this would result in the rod protruding above the user's hip 114 when the knee 118 is bent. In this configuration, the load may be attached with the end of the rod to allow its weight to be transferred to the rod.

Therefore, the load would bounce up and down during walking. Furthermore, this system would still require the user to lift the entire weight of the load when bring up their heel, similar to the "fighting the spring" problem previously described.

The solution proposed by the present invention decouples the stance 102 and swing 104 phases of walking. This allows the exoskeleton to bear a load during the stance phase 102, but to bear substantially no load during the swing phase 104 (recovery), so the individual does not fight the device when swinging a leg forward. This can be accomplished through use of the exoskeleton described herein. Since the distance between the hip 114 and ankle 116 is also allowed to vary, the knee 118 can be bent and the user does not have the "unbent knee" problem. On the other hand, the rod bears no load during the swing phase 104 (recovery) so there is no "fighting the spring" problem. In addition, a mechanism at the ankle 116 allows the weight of the load to be transferred to a ground surface and eliminates the need for the user to exert extra effort to lift their ankle 116 during the swing phase 104. The details of the exoskeleton described herein are further described below.

(3) Description

Figure 2:
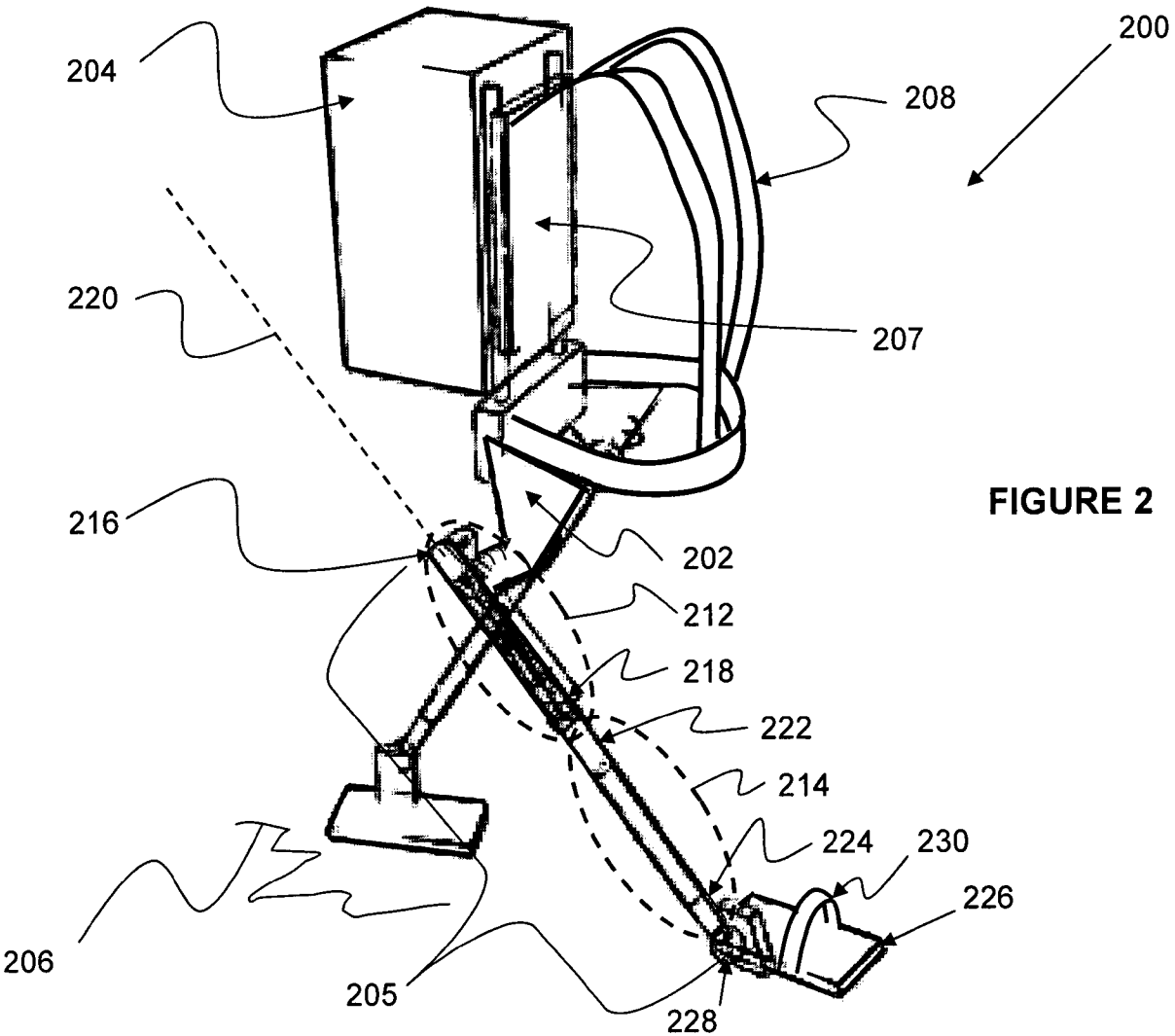
FIG. 2 is an illustration of a perspective view of a passive exoskeleton according to the present invention.

FIG. 2 illustrates a passive exoskeleton 200 according to the present invention. The exoskeleton 200 comprises a body member 202 for transferring weight of a load 204 to a sliding rod 205, and thereafter to a ground surface 206. Additionally, a load frame 207 may be attached with the body member 202, thereby allowing the load 204 to be secured with the exoskeleton 200. The body member 202 may be any suitable mechanism for transferring and bearing weight, non-limiting examples of which include a rigid plate and a rigid hip attachment. For example, the rigid hip attachment may be a metallic bar that wraps around a user's hip. In this aspect, the weight of the load 204 would be transferred to the metallic bar, and thereafter through the connected sliding rod 205 and on to the ground surface 206.

Additionally, a body attachment 208 may be attached with the body member 202. The body attachment 208 is for attaching the exoskeleton 200 with a torso portion of a user, allowing the user to operate the exoskeleton 200 and maintain the exoskeleton 200 in a position proximate the user. The body attachment 208 may be any suitable mechanism or device for maintaining one object proximate another, non-limiting examples of which include a flexible harness, a belt, and suspenders.

The sliding rod 205 is attached with the body member 202. The sliding rod 205 is constructed of any suitably rigid material, a non-limiting example of which includes metal, plastic, and composite materials. The sliding rod 205 comprises an alignment rod 212 and a load rod 214. The alignment rod 212 has a top portion 216, a bottom portion 218, and a length with an axis 220 therethrough. The alignment rod 212 may be any suitable mechanism or device for maintaining an alignment of an object, non-limiting examples of which include a cylindrical tube, an elongated plate, a rod, and a metallic bar. The top portion 216 of the alignment rod 212 is attached with the body member 202 through a mechanism that allows movement therebetween, a non-limiting example of which includes being pivotally attached through use of a pin, or ball joint such as a hip joint.

The load rod 214 is in a fixed parallel alignment with the axis 220 of the alignment rod 212. The load rod 214 is a mechanism or device for bearing a load, non-limiting examples of which include a cylindrical tube, an elongated plate, a rod, and a metallic bar. The load rod 214 has a top part 222 and a bottom part 224, and is connected with the alignment rod 212 such that a length of the sliding rod 205 is adjustable by sliding the top part 222 of the load rod 214 between the bottom portion 218 and top portion 216 of the alignment rod 212. As a non-limiting example, the alignment rod 212 is a cylindrical tube and is positioned within a larger cylindrical tube of the load rod 214, allowing the two rods to be slid past each other, thereby varying the length of the sliding rod 205.

In order to transmit the weight of the load 204 to the ground, the load rod 214 must be connected to something in contact with the ground. This is accomplished through use of a ground surface engage-able foot analog 226 that is attached with the bottom part 224 of the load rod 214. The foot analog 226 is attached with the load rod 214 through a suitable mechanism or device allowing movement therebetween, a non-limiting example of which includes being pivotally attached through use of an ankle joint 228. The foot analog 226 is constructed such that it is engageable with both a ground surface and with a user's foot. As a non-limiting example, the foot analog 226 may be a platform for connecting with a bottom side of a user's shoe.

If the load rod 214 was only attached to the user's boot at the ankle with no foot analog 226, during toe-off the user would need to use a calf muscle to lift up the heel and thus the entire weight of the load 204. Having to lift the entire weight of the load 204 at each toe-off would be difficult to do and could present a significant mechanical burden. By using a foot analog 226 such as a platform, the load rod 214 is able to support the weight of the load 204 and transmit it to the ground without requiring additional effort from the user's calf muscle.

A foot connector 230 is attached with the foot analog 226, allowing a user to securely attach the foot analog 226 with the user's foot or shoe, thereby allowing the foot analog 226 to maintain a position proximate the user's foot. The foot connector 230 may be any suitable mechanism or device for fastening one object against another, non-limiting examples of which include Velcro™ straps, clips, and buckles.

Figure 3:
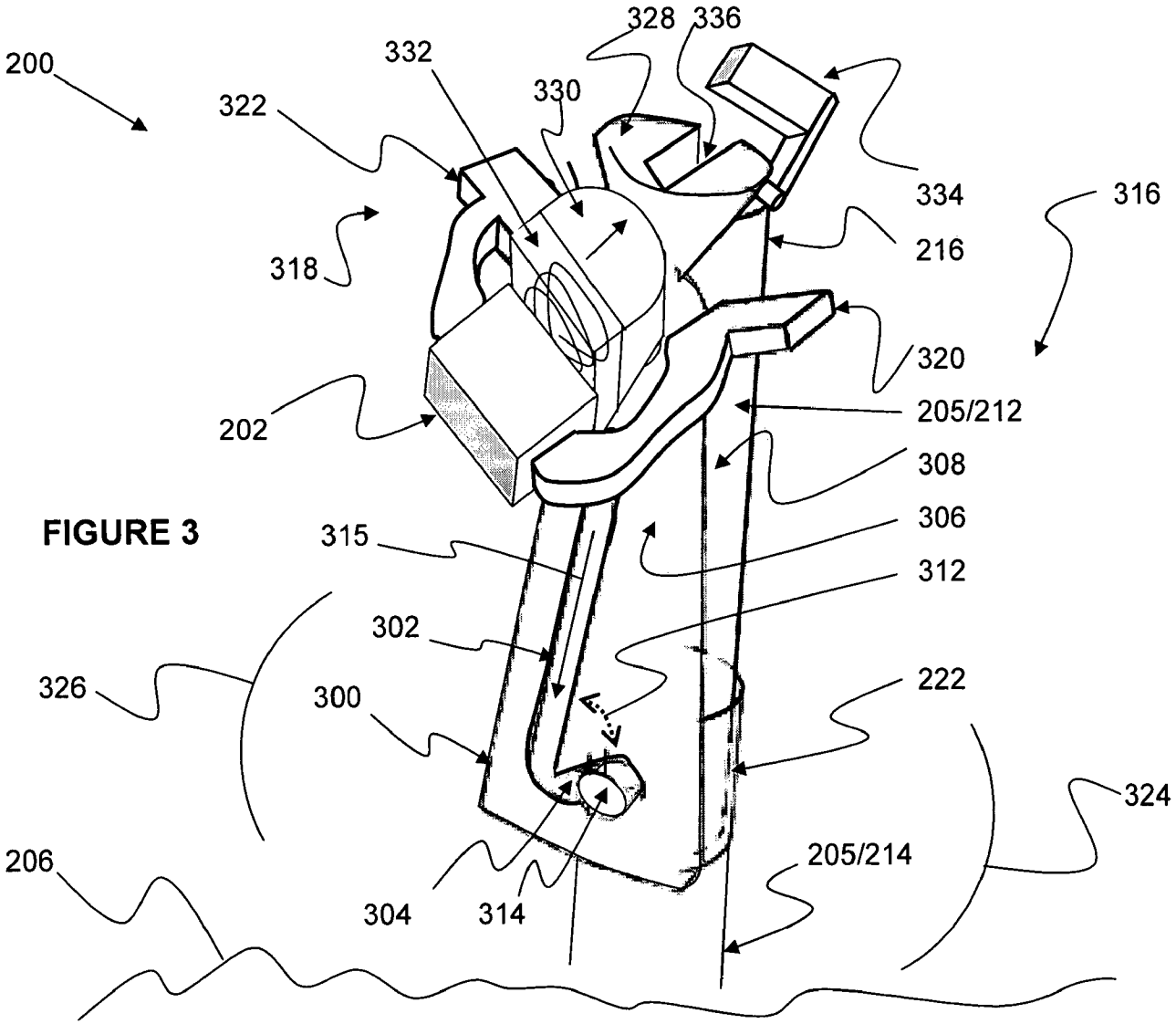
FIG. 3 is an illustration of a perspective view of a rocker according to the present invention.

A user's leg can only support a load during the stance phase. For example, a user has two legs and as the user walks, each leg shifts between the stance and swing phases. While one leg is substantially in the swing phase, the other leg is substantially in the stance phase. Accordingly, during the swing phase, the other leg is supporting the load as it is in the stance phase. Therefore, the exoskeleton further comprises a rocker 300, as shown in FIG. 3. The rocker 300 helps support the weight of a load during the stance phase, but does not inhibit motion during the swing phase. The rocker 300 is attached with the body member 202 through a mechanism or device allowing movement therebetween, a non-limiting example of which includes being pivotally attached through use of a hip pin or a ball joint. The rocker 300 has a travel channel 302 and a load channel 304 incorporated therein. Furthermore, both the travel channel 302 and the load channel 304 pass through the rocker 300 from a first side 306 to a second side 308.

The travel channel 302 is an elongated channel constructed such that it is oriented directionally from proximate the body member 202 to the ground surface 206. The load channel 304 is an elongated channel positioned such that an angle 312 between the load channel 304 and the travel channel 302 is less than ninety degrees.

A load pin 314 is attached with the top part 222 of the load rod 214. The load pin 314 is positioned such that it is operably attached with the rocker 300 through both the travel channel 302 and the load channel 304. When the load pin 314 is in the travel channel 302, the two rods can slide relative to one another and substantially no weight is carried by that particular rocker 300.

When a user walks and shifts from a swing phase to a stance phase, the shift causes the load pin 314 to travel down 315 the travel channel 302 and into the load channel 304, thereby shifting the load from the rocker 300, onto the load pin 314, and thereafter through the load rod 214 and the foot analog to the ground surface 206.

The body member 202 has a front side 316 and a rear side 318. A front rocker stop 320 is attached with the front side 316 of the body member 202 and a rear rocker stop 322 is attached with the rear side 318 of the body member 202. When a user is walking, the rocker 300 swings between a forward position 324 and a rear position 326. When the rocker is in a forward position 324, a top component 328 of the rocker 300 engages with the rear rocker stop 322. When the rocker 300 is in a rear position 326, the top component 328 engages with the front rocker stop 320.

A bias block 330 is attached with the body member 202 to divide the region between the two rocker stops 320/322. Without the bias block 330, the rocker 300 has no interaction at its top component 328 until it hits the rocker stops 320/322 at the limit of its travel in a full stride gait. To aid the bias block 330 in interacting with the top component 328, a pressure mechanism 332 is attached with the bias block 330. The pressure mechanism 332 is attached with the bias block in a suitable manner to force the bias block 330 against the top component 328 of the rocker 300. As a non-limiting example, the pressure mechanism 332 is placed between the body member 202 and the bias block 330, and is a mechanism with suitable expansion and contraction properties. As non-limiting examples of suitable mechanisms, the pressure mechanism 332 may be a spring or hydraulic system forcing the bias block 330 against the top component 328. For example, if a hydraulic system, a hydraulic mechanism (e.g., such as a shock similar to those used in automobiles) may be attached with the bias block 330 to force it against the top component 328, such that as the top component 328 moves, the hydraulic system adjusts itself to continually force the bias block 330 into the top component 328.

The bias block 330 serves to rotate the rocker 300 such that the load pin 314 is moved from the load channel 304 to the travel channel 302, or back. The pressure applied by the bias block 330 against the top component 328 of the rocker 300 (i.e, via the pressure mechanism 332) is sufficient to rotate the rocker 300 either clockwise or counter clockwise when the stride/gait shifts the load off the load pin 314. When under load, the load pin 314 will be locked in the load channel 304 and the bias block 330 will not be able to rotate the rocker 300.

The bias block 330 rotates the rocker 300 in the same direction as the top is inclined (with respect to the quasi-equilibrium point). This means when walking backwards, the top of the rocker is inclined clockwise as the user steps backward. As the load pin 314 reaches the intersection of the load 304 and travel channels 302, the bias block 330 further rotates the rocker 300 clockwise which moves the load pin 314 from the travel channel 302 into the load channel 304. This works in the same way as the user (still walking backwards) goes into the recovery part of the stride and lifts up thier foot (having shifted the weight off that leg onto the other), with the bias block 330 rotating the rocker 300 counterclockwise to move the load pin 314 from the load channel 304 into the travel channel 302, permitting the user to lift their foot without opposition of the passive exoskeleton 200.

Further, the bias block 330 can be angled to permit vertical engagement when taking stairs either upward or downward. Ascent techniques depend on proper bias block 330 angle and a proper travel channel 302 length (i.e., minimum length must exceed the height of a stair step). However, the stair ascent is a matter of technique. The important part is the bias block 330 which permits the rocker 300 to engage and disengage during the gait. Details of the stair ascent or descent are dependent on the particular configuration (i.e., orientation) of the bias block 330.

For example, the bias block 330 assumes a smaller step backward than forward, where the rocker stops must be set far enough apart to provide the bias block 330 with sufficient space to function. The bias block 330 function is dependent on the orientation of the load channel 304 to the travel channel 302. Thus, if the rocker 300 were flipped, and the load channel 304 were to head in the opposite direction, then small steps forward would be enabled by the bias block 330 and large steps backward by the rocker stops.

To neutralize (i.e., turn off) the passive exoskeleton, a neutral block 334 is attached with the top portion 216 of the alignment rod 212. The neutral block 334 is configured such that it is engage-able with the top component 328 of the rocker 300. When the load pin is in the travel channel, the rocker is aligned with the sliding rods 205 and, more particularly, with the alignment rod 212. An engaging portion 336 (a non-limiting example of which includes a slot) exists in the top component 328 of the rocker 300, such that when the engaging portion 336 is engaged between the alignment rod 212 and the top component 328 (i.e., when directly aligned), the rocker 300 will remain aligned with the sliding rod 205. This alignment keeps the load pin 314 affixed in the travel channel 302.

When the neutral block is engaged 334 and the load pin 314 is affixed in the travel channel 302, the passive exoskeleton 200 does not bear any of the load and therefore does not benefit a user. This is because the load pin 314 remains in the travel channel 302, the travel channel 302 remains aligned with the sliding rod 205, and the load pin 314 does not enter the load channel 304. Additionally, when the neutral block 334 is engaged, the rocker 300 is not free to rotate and therefore does not interfere with the stride of the user during the user's gait.

(4) The Present Invention in Motion

The passive exoskeleton of the present invention is well-suited for both forward and reverse motion. Although the rocker and rocker stops are sufficient for forward motion, the rocker and rocker stops alone do not allow for sufficient reverse motion. Accordingly, the present invention includes the bias block and pressure mechanism which aids in rotating the rocker during reverse motion. To improve clarity, this section is divided into two subsections, forward motion and reverse motion. FIGS. 4 through 30B illustrate forward motion, showing the function of the rocker and rocker stops. FIGS. 31A through 43B illustrate reverse motion, showing the function of the rocker, the bias block, and the pressure mechanism, as taken from a right hip view. Although the bias block is also functional during forward motion, it is illustrated herein to emphasize its applicability to reverse motion. As can be appreciated by one in the art, the described motions of the bias block (i.e., while in backward motion), can be reversed to illustrate the bias block in a forward motion.

(i) Forward Motion

Figure 4:
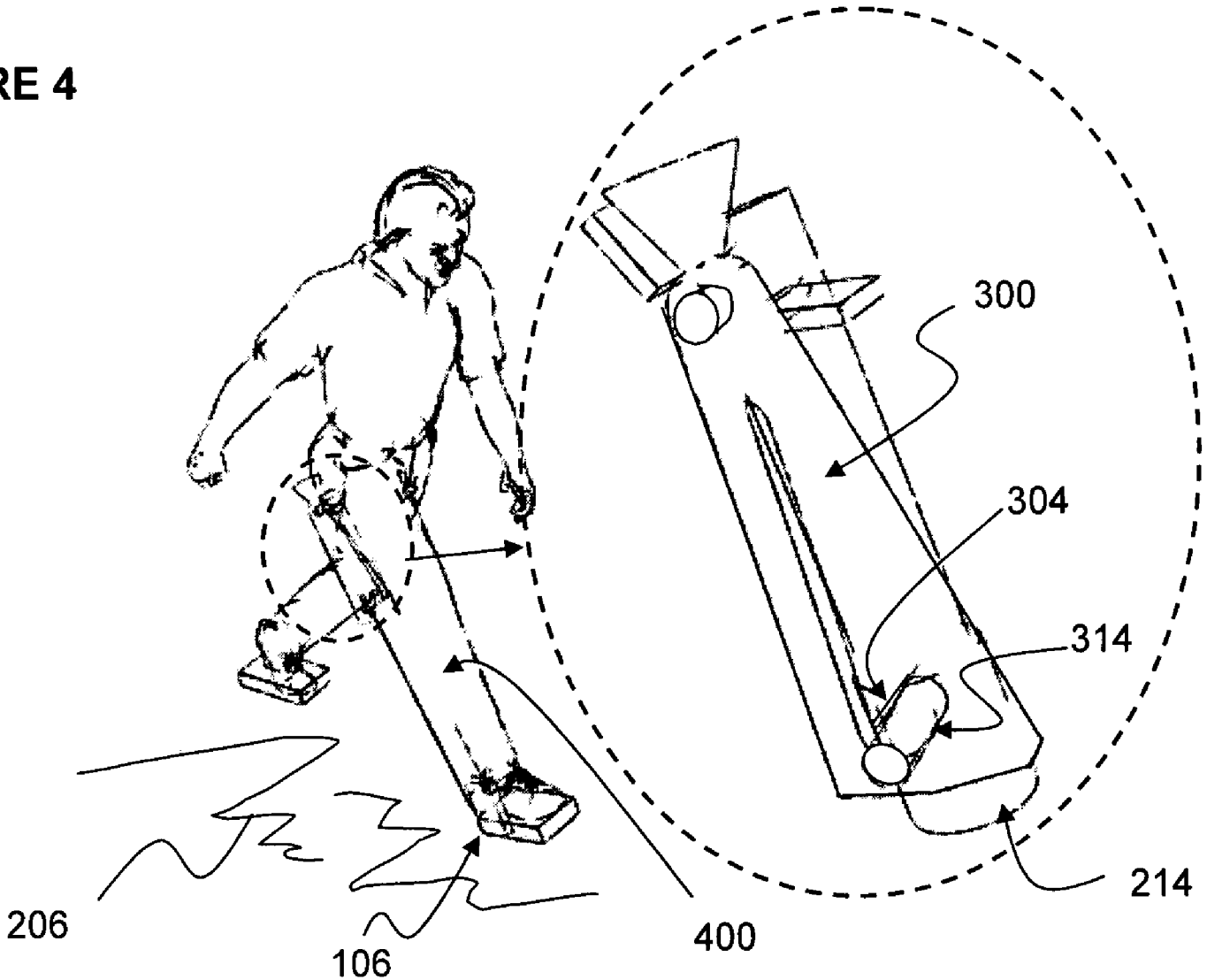
FIG. 4 is an illustration of a magnified, perspective view of a rocker according to the present invention, illustrating a position of a load pin in relation to the rocker during a stance phase.

As shown in FIG. 4, during heel-strike 106 (initial contact), the load pin 314 is in the load channel 304. As weight is transferred to a user's right leg 400, the weight of a load is transferred through the body member and rocker 300, via the load pin 314, to the load rod 214 and the ground 206. The rocker 300 continues to bear weight of the load during the stance phase as the load pin 314 remains in the load channel 304.

Figure 5:
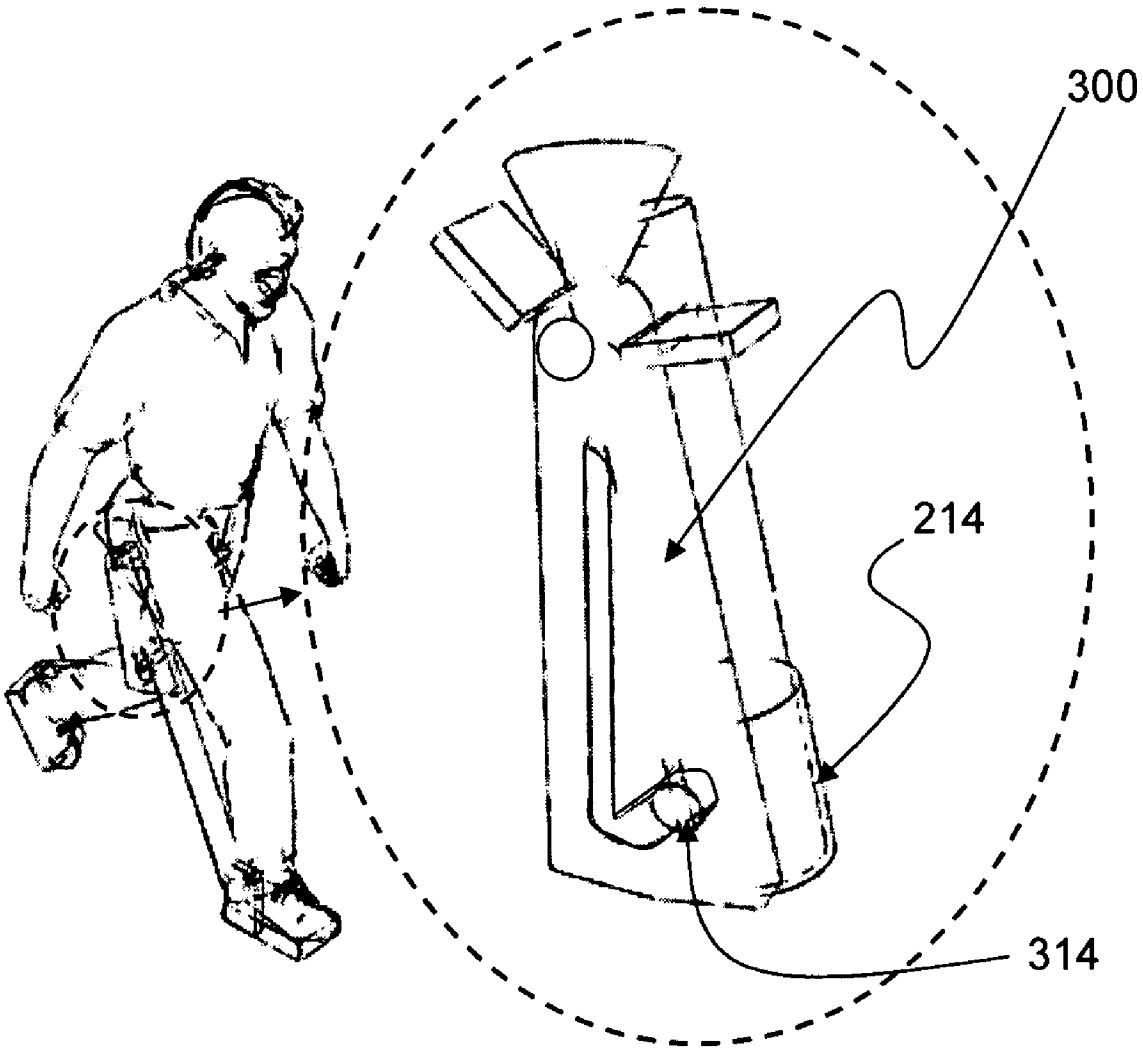
FIG. 5 is an illustration of a magnified, perspective view of a rocker according to the present invention, illustrating a position of the load pin in relation to the rocker during another stance phase.
Figure 6:
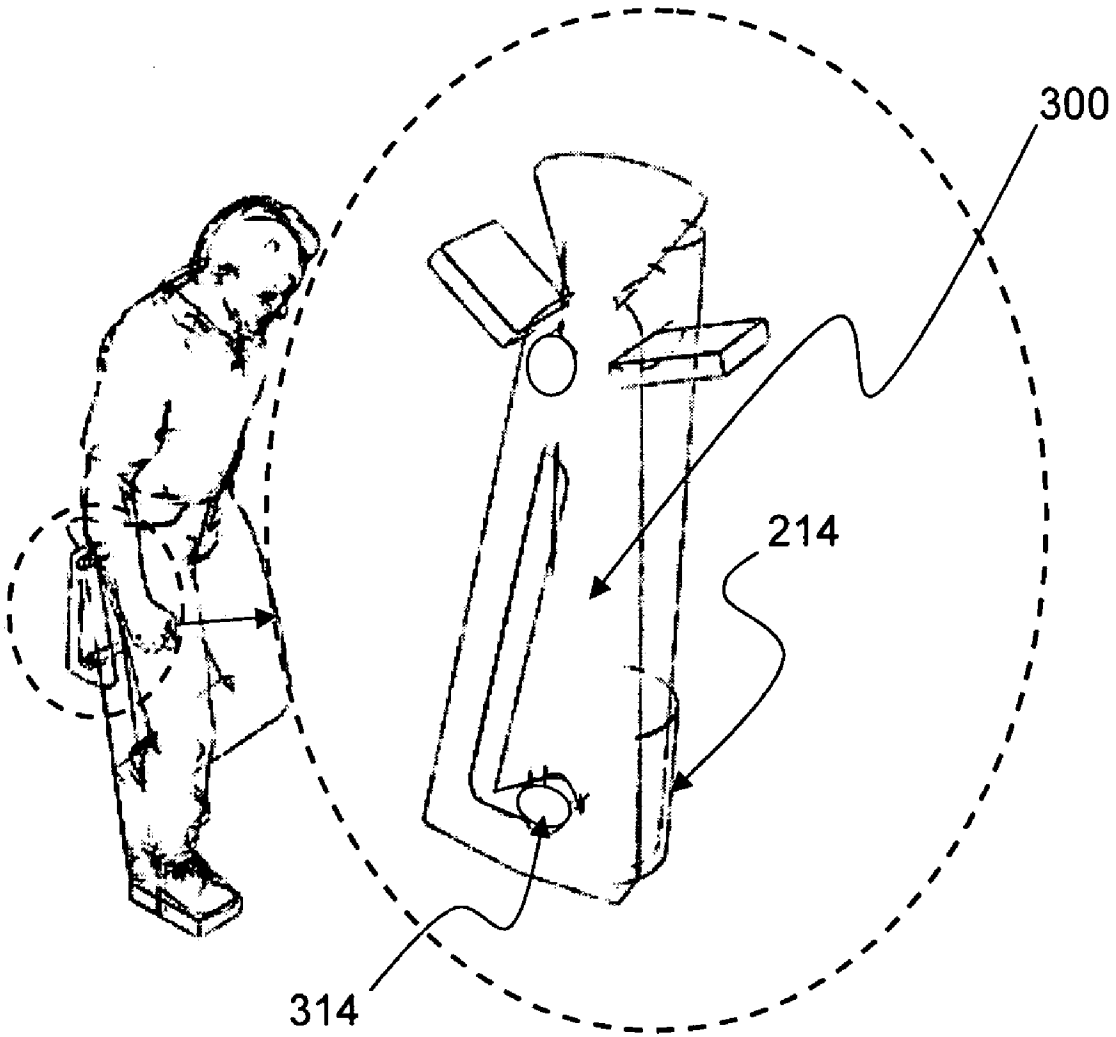
FIG. 6 is an illustration of a magnified, perspective view of a rocker according to the present invention, illustrating a position of the load pin in relation to the rocker during still another stance phase.
Figure 7:
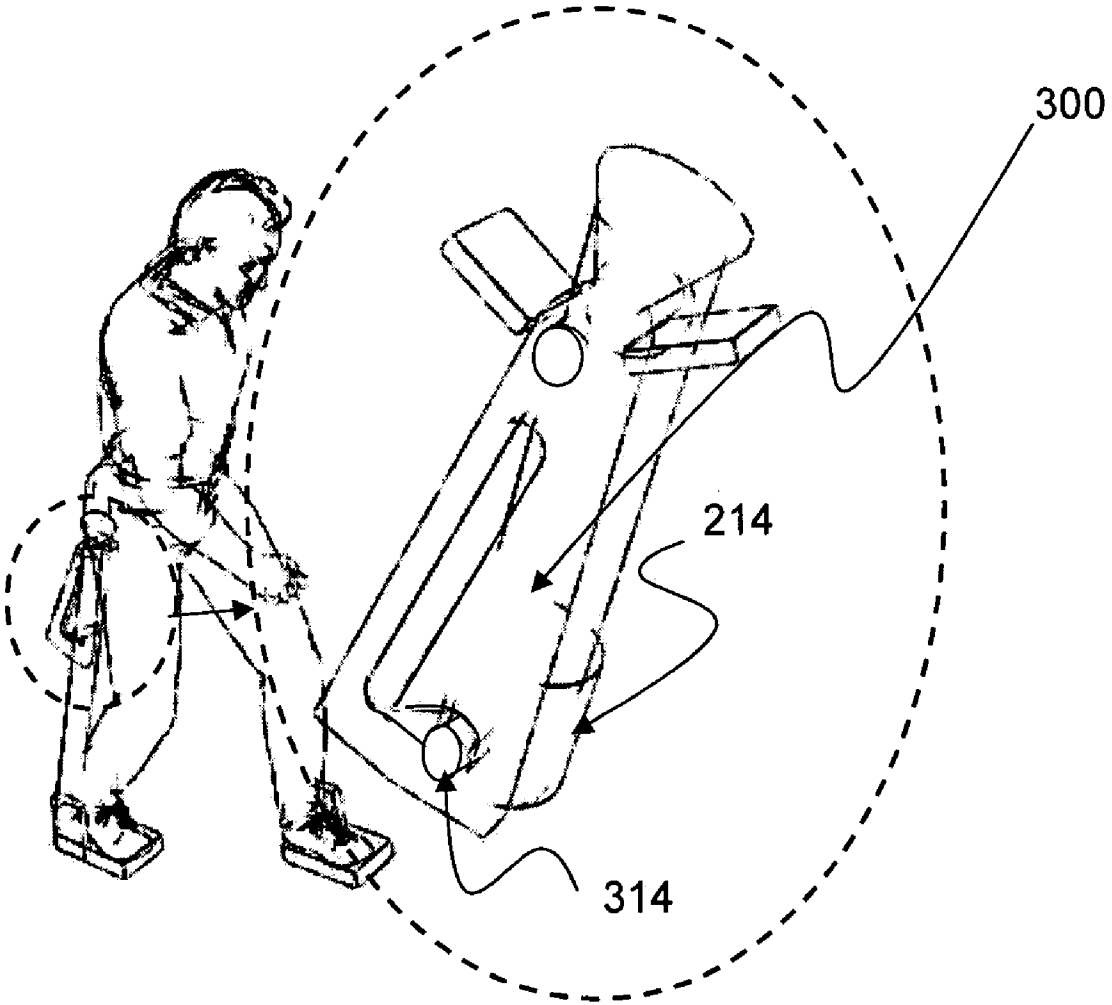
FIG. 7 is an illustration of a magnified, perspective view of a rocker according to the present invention, illustrating a position of the load pin in relation to the rocker during yet another stance phase.

FIGS. 5, 6, and 7 illustrate the loading response, mid-stance and terminal stance positions respectively. As shown in FIGS. 5, 6, and 7, during these positions the weight of the load continues to be borne by the load pin 314, which transfers the weight from the rocker 300 to the load rod 214.

Figure 8:
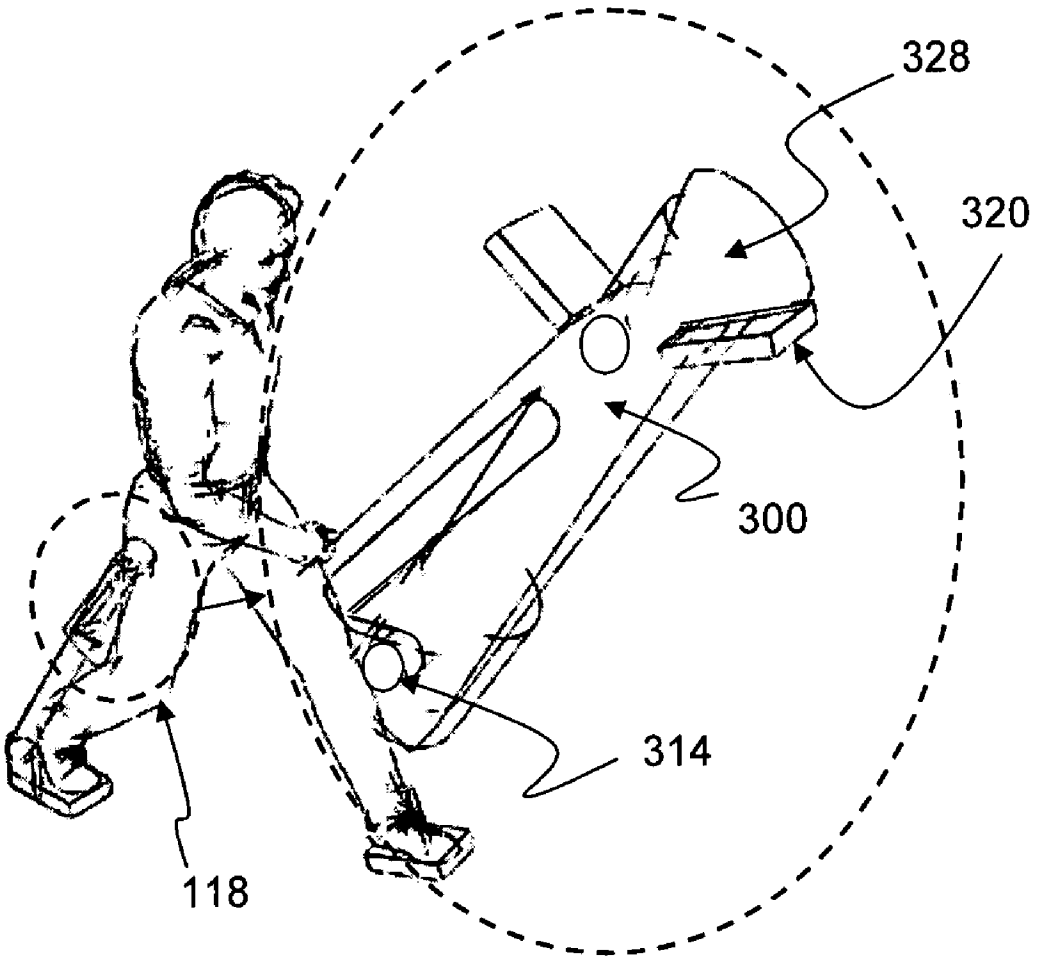
FIG. 8 is an illustration of a magnified, perspective view of a rocker according to the present invention, illustrating a position of the load pin in relation to the rocker during a further stance phase.

As shown in FIG. 8, the weight of the load continues to be borne by the load pin 314 until the pre-swing phase, just before toe-off. At this point, the top component 328 of the rocker 300 reaches the front rocker stop 320, which prevents further rotation of the rocker 300. Before completing the stance phase, the load pin 314 continues to move up and to the left since the right knee 118 is bending. However, once the rocker 300 can no longer rotate, the load pin 314 is forced up into the travel channel 302.

Figure 9:
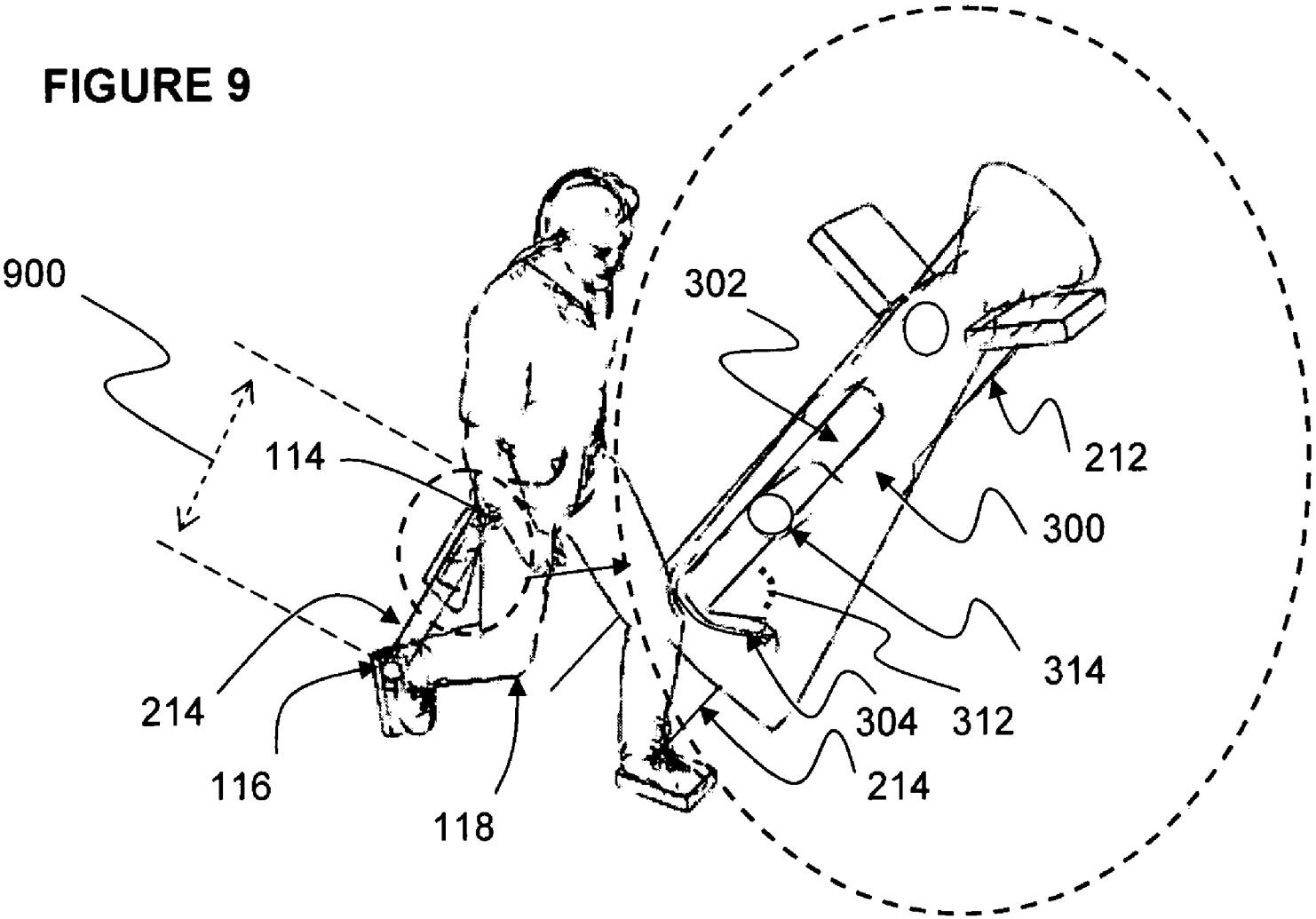
FIG. 9 is an illustration of a magnified, perspective view of a rocker according to the present invention, illustrating a position of the load pin in relation to the rocker during a swing phase.

As shown in FIG. 9, during the initial swing and as the knee 118 bends, the distance between the ankle 116 and hip 114 joint decreases. The load pin 314 then travels along the travel channel 302 and substantially no weight is transferred from the rocker 300 to the load rod 214.

The majority of variation in the hip-to-ankle distance 900 occurs during the swing phase. This is not a problem because the load pin 314 is in the travel channel 302 during this portion of the stride and the two rods (i.e., alignment rod 212 and load rod 214) can slide freely relative to one another. As long as the stance and swing phases can be de-coupled using the rocker 300, it is possible to use the rocker's 300 geometry in conjunction with a variety of springs and dashpots to smooth the motion. A spring placed in the load channel 304, for example, would help smooth the motion of the load pin 314 during the stance phase. This would also prevent the load pin 314 from reaching the base of the load channel 304 and would therefore allow a smaller angle 312 between the load channel 304 and the travel channel 302. This angle 312 could compensate for some variation in the hip-to-ankle distance 900 during the stance phase.

Figure 10:
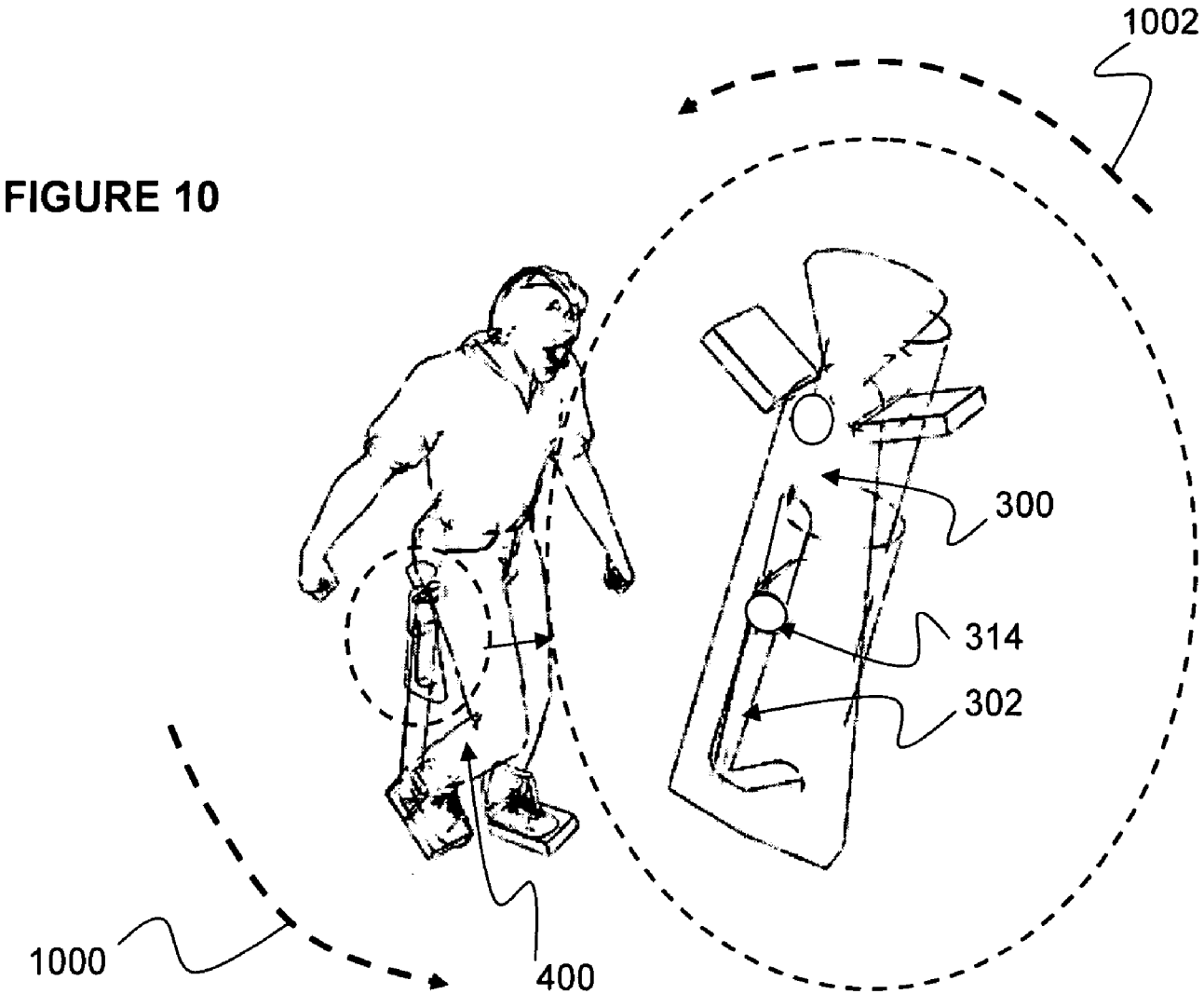
FIG. 10 is an illustration of a magnified, perspective view of a rocker according to the present invention, illustrating a position of the load pin in relation to the rocker during another swing phase.
Figure 11:
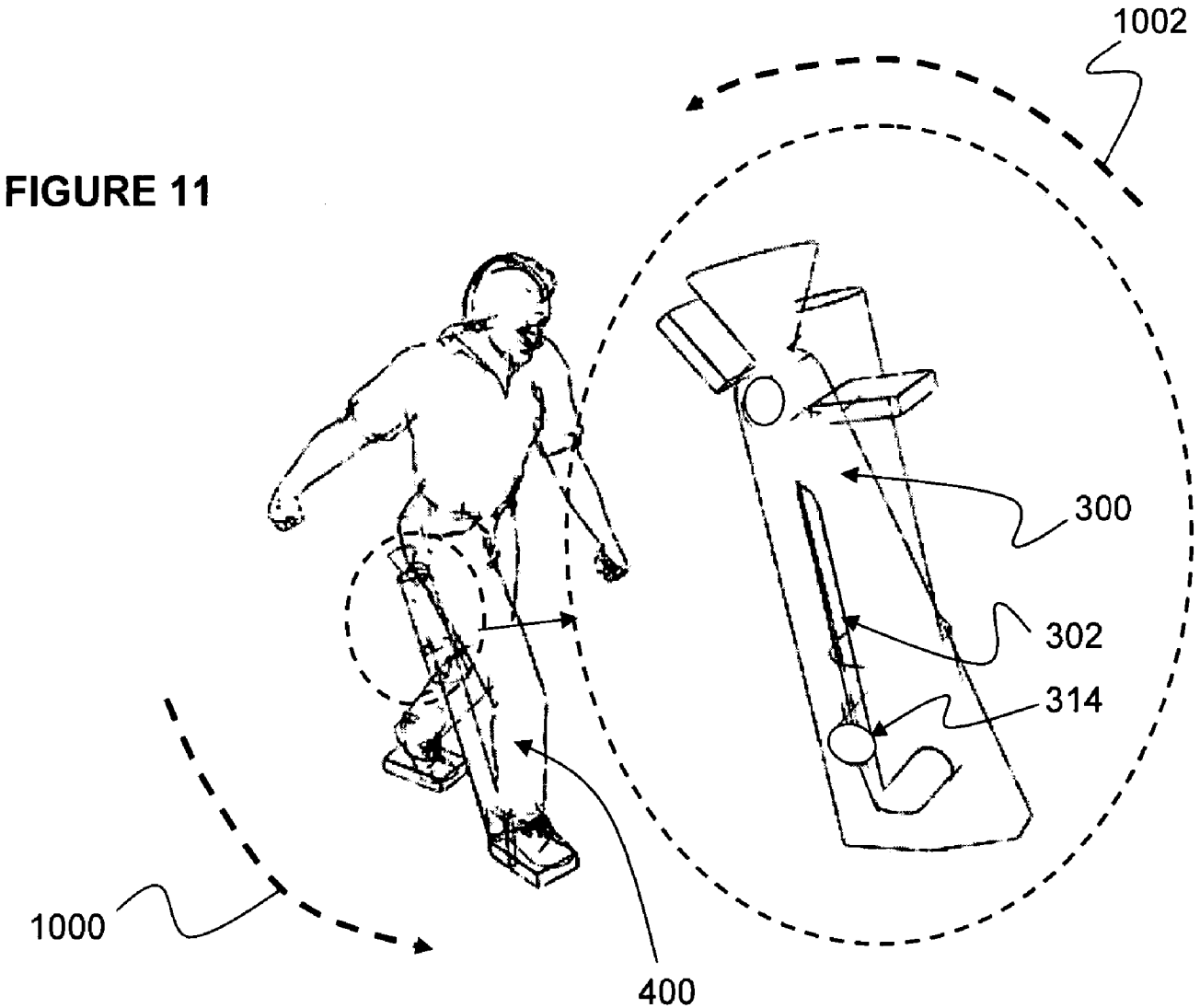
FIG. 11 is an illustration of a magnified, perspective view of a rocker according to the present invention, illustrating a position of the load pin in relation to the rocker during still another swing phase.

FIGS. 10 and 11 illustrate the mid swing and terminal swing positions respectively. As shown in FIGS. 10 and 11, as the user continues to walk and the leg 400 swings forward 1000, the rocker 300 rotates in a counter-clockwise direction 1002, with the load pin 314 continuing to travel along the travel channel 302. While traveling in the travel channel 302, the load pin 314 carries no load until the point where the right leg 400 is about to touch the ground again.

Figure 12:
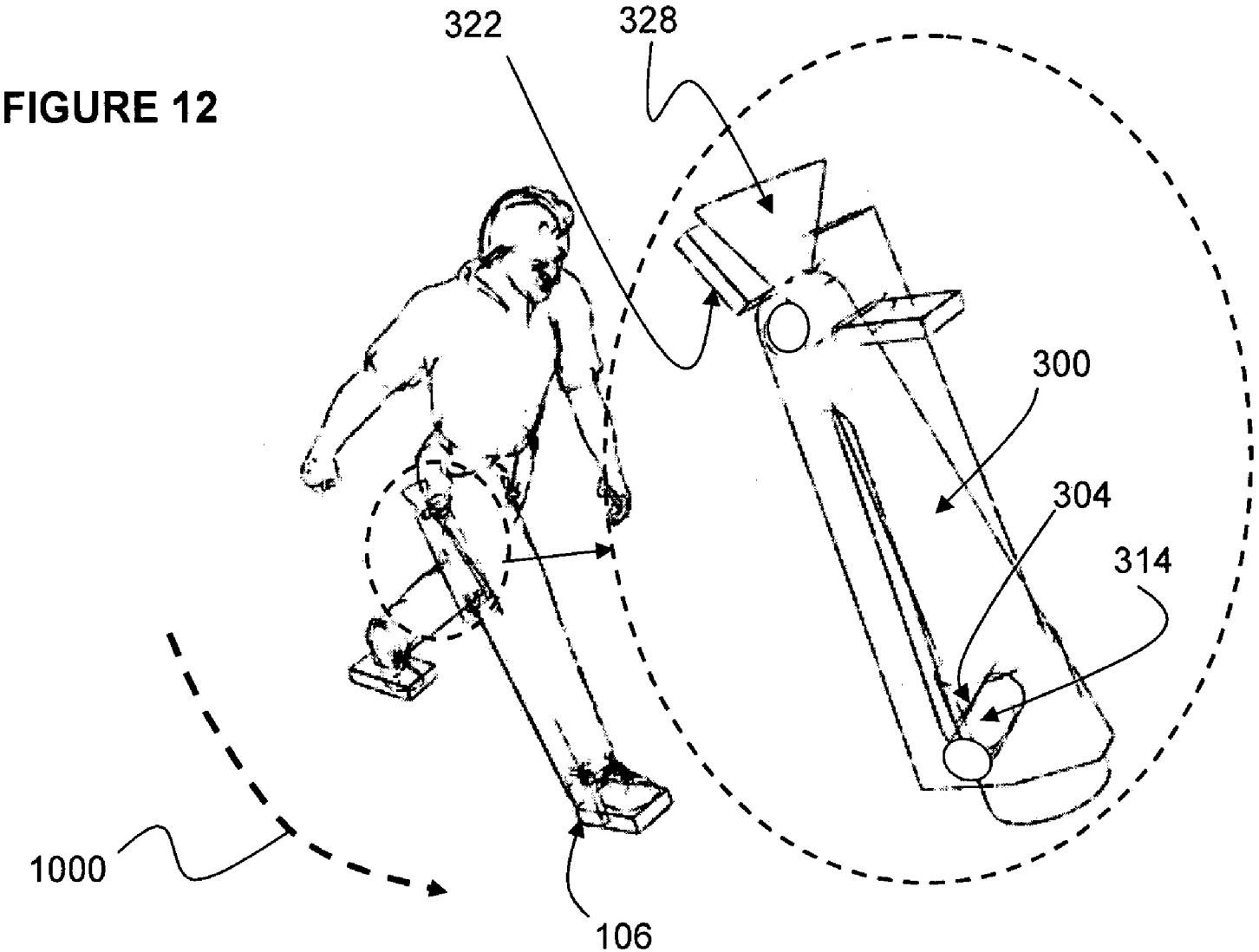
FIG. 12 is an illustration of a magnified, perspective view of a rocker according to the present invention, illustrating a position of the load pin in relation to the rocker during an end of the swing phase.
Figure 14B:
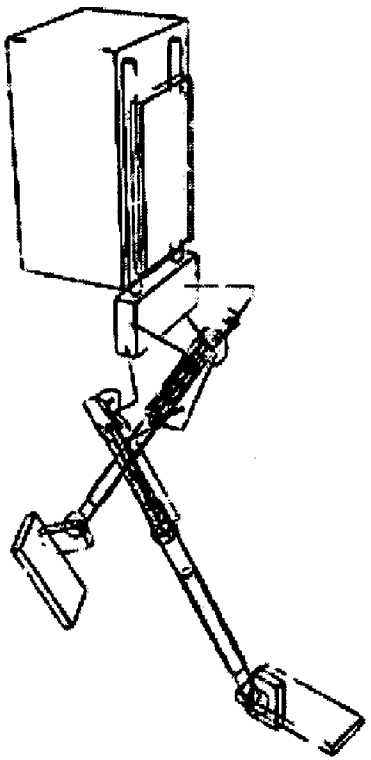
FIG. 14B is an illustration of the passive exoskeleton in the position shown in FIG. 14A, without the user.
Figure 14A:
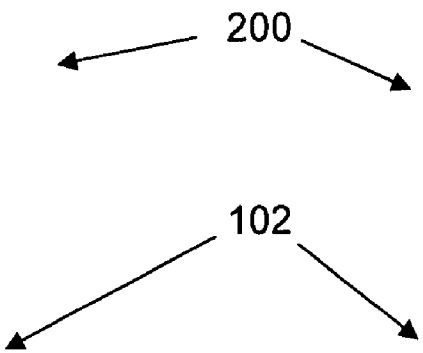
FIG. 14A is an illustration of a perspective view of a passive exoskeleton attached with a user, where a right leg of a user is in a loading response of another stance phase.
Figure 14A:
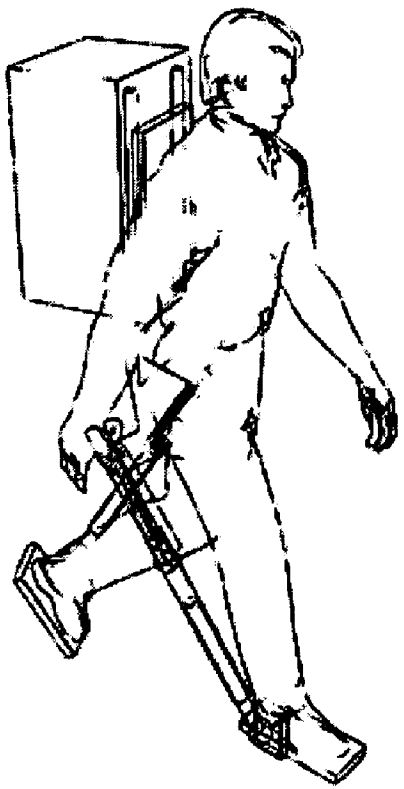
Figure 15B:
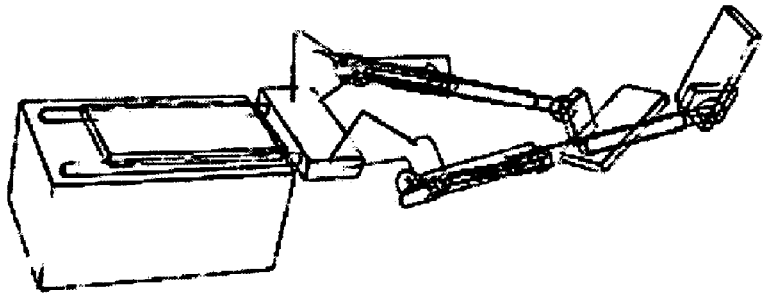
FIG. 15B is an illustration of the passive exoskeleton in the position shown in FIG. 15A, without the user.
Figure 15A:
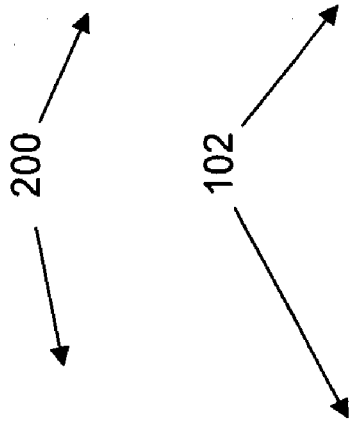
FIG. 15A is an illustration of a perspective view of a passive exoskeleton attached with a user, where a right leg of a user is in a mid-stance of the stance phase.
Figure 15A:
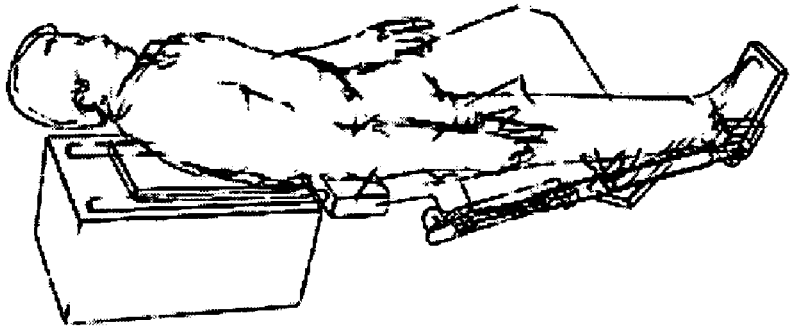
Figure 16B:
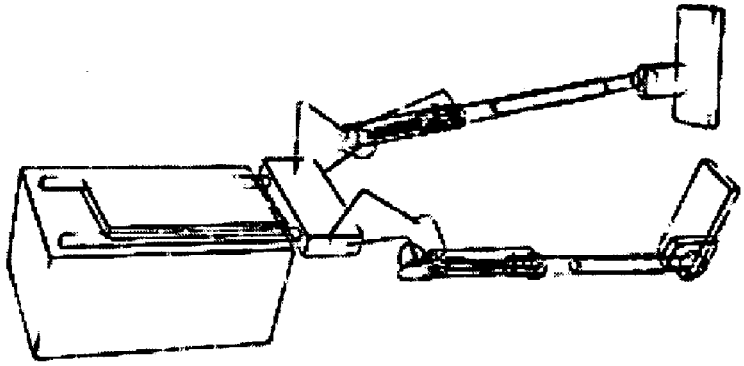
FIG. 16B is an illustration of the passive exoskeleton in the position shown in FIG. 16A, without the user.
Figure 16A:
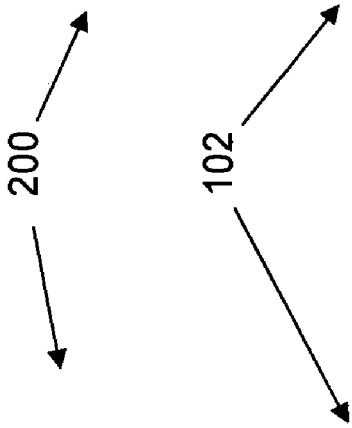
FIG. 16A is an illustration of a perspective view of a passive exoskeleton attached with a user, where a right leg of a user is in a terminal stance of the stance phase.
Figure 16A:
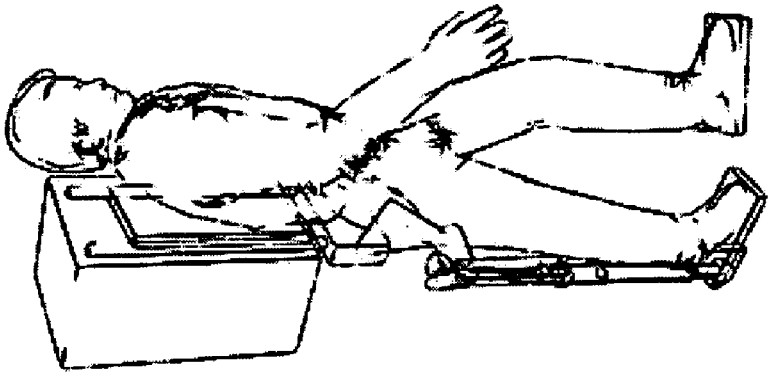
Figure 17B:
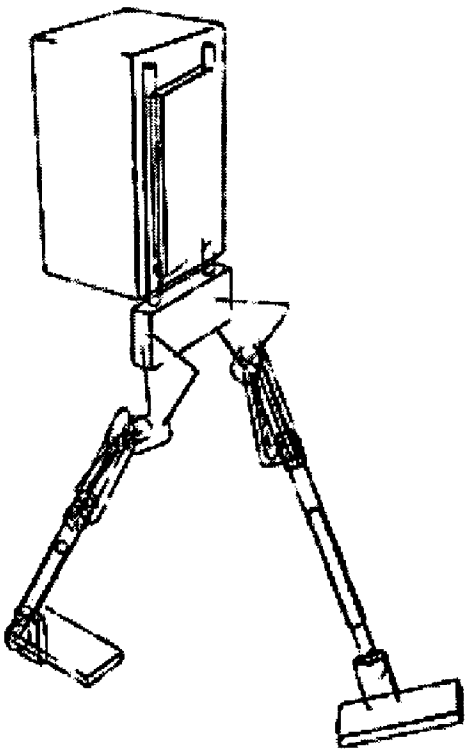
FIG. 17B is an illustration of the passive exoskeleton in the position shown in FIG. 17A, without the user.
Figure 17A:
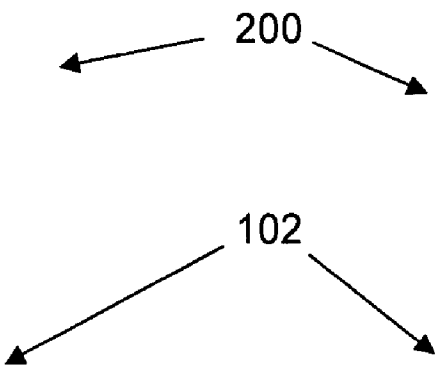
FIG. 17A is an illustration of a perspective view of a passive exoskeleton attached with a user, where a right leg of a user is in a pre-swing of a stance phase.
Figure 17A:
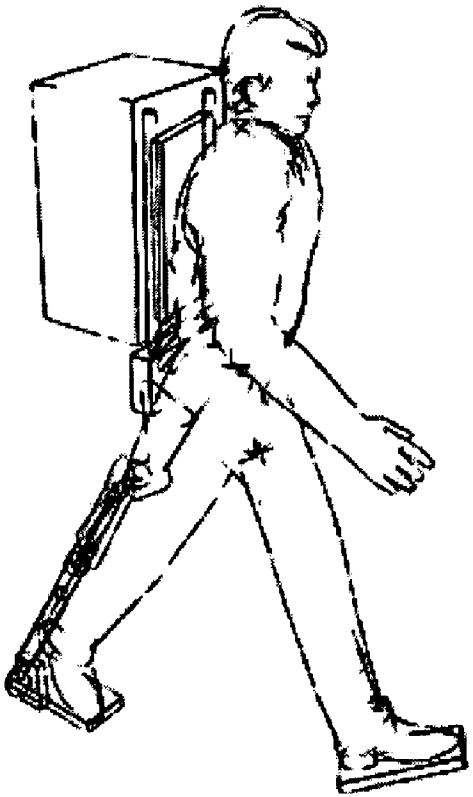
Figure 18B:
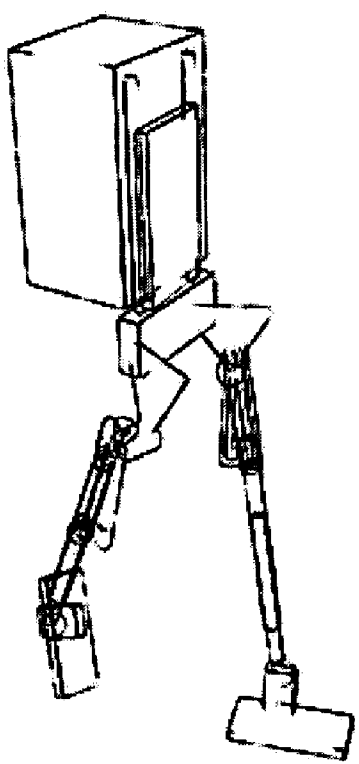
FIG. 18B is an illustration of the passive exoskeleton in the position shown in FIG. 18A, without the user.
Figure 18A:
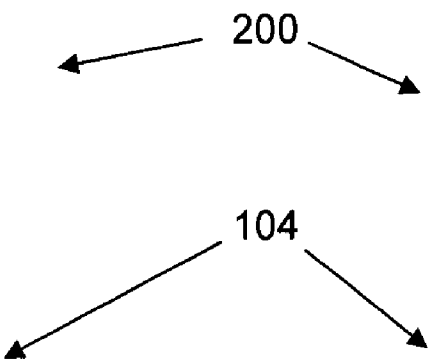
FIG. 18A is an illustration of a perspective view of a passive exoskeleton attached with a user, where a right leg of a user is in an initial swing of the swing phase.
Figure 18A:
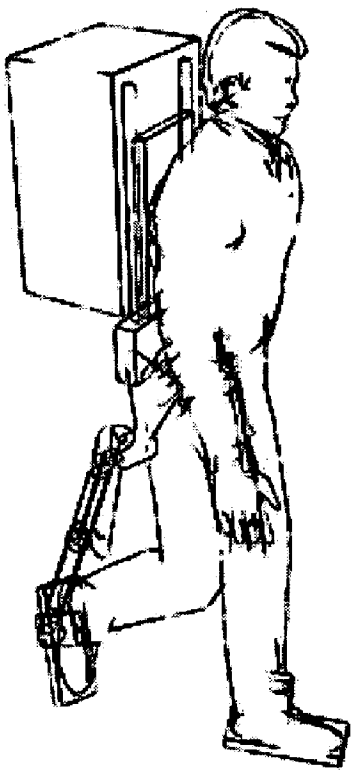
Figure 19B:
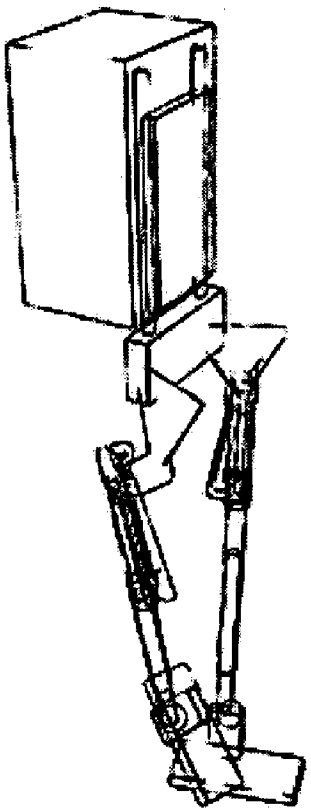
FIG. 19B is an illustration of the passive exoskeleton in the position shown in FIG. 19A, without the user.
Figure 19A:
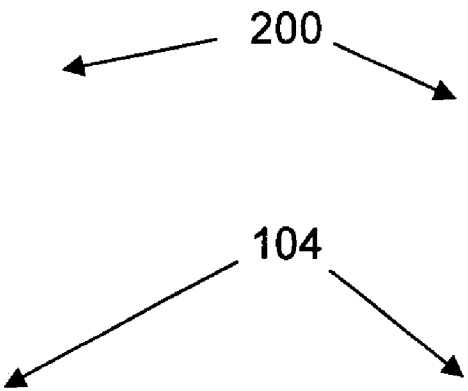
FIG. 19A is an illustration of a perspective view of a passive exoskeleton attached with a user, where a right leg of a user is in a mid-swing of the swing phase.
Figure 19A:
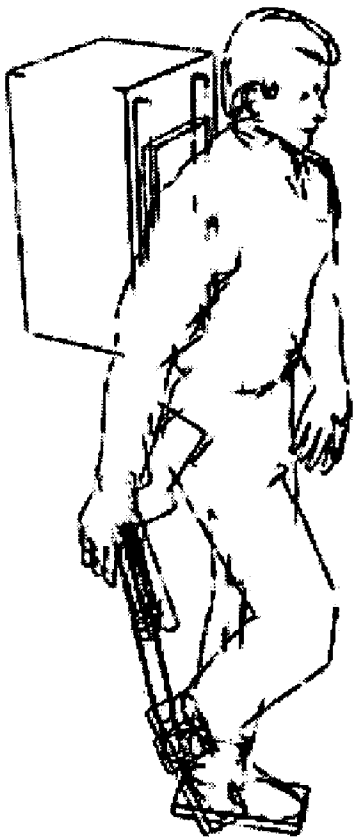
Figure 20B:
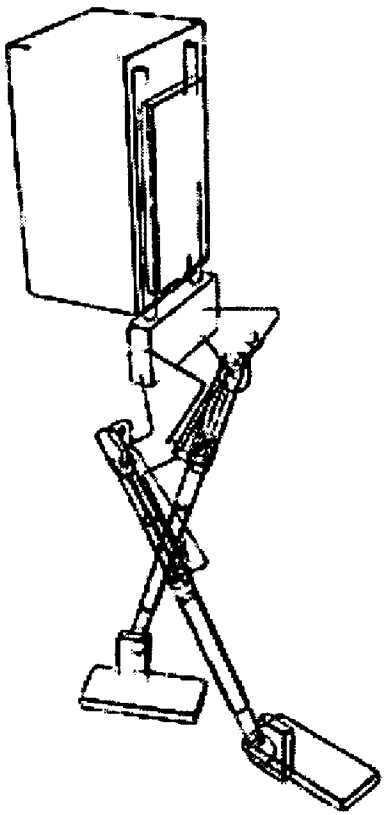
FIG. 20B is an illustration of the passive exoskeleton in the position shown in FIG. 20A, without the user.
Figure 20A:
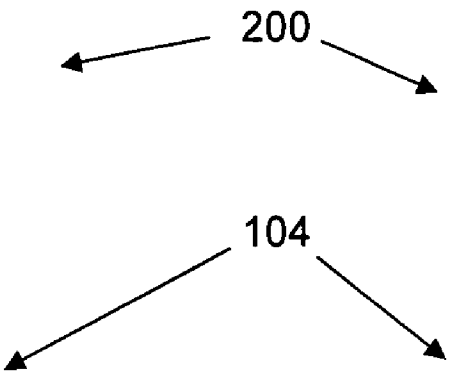
FIG. 20A is an illustration of a perspective view of a passive exoskeleton attached with a user, where a right leg of a user is in an initial swing of the swing phase.
Figure 20A:
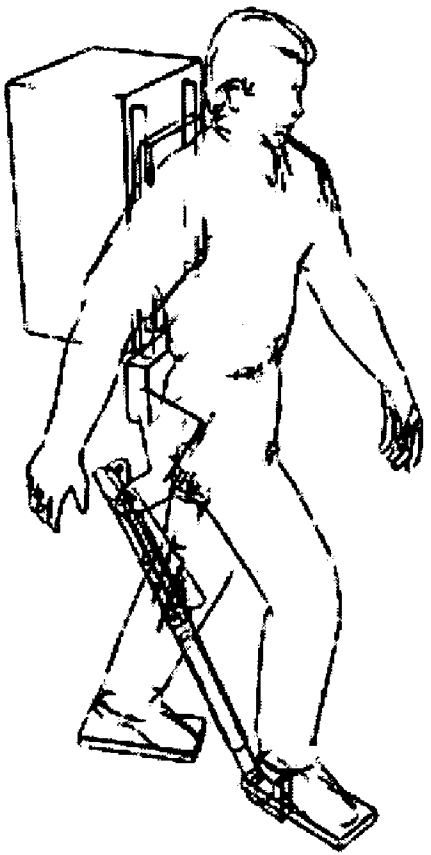
Figure 21B:
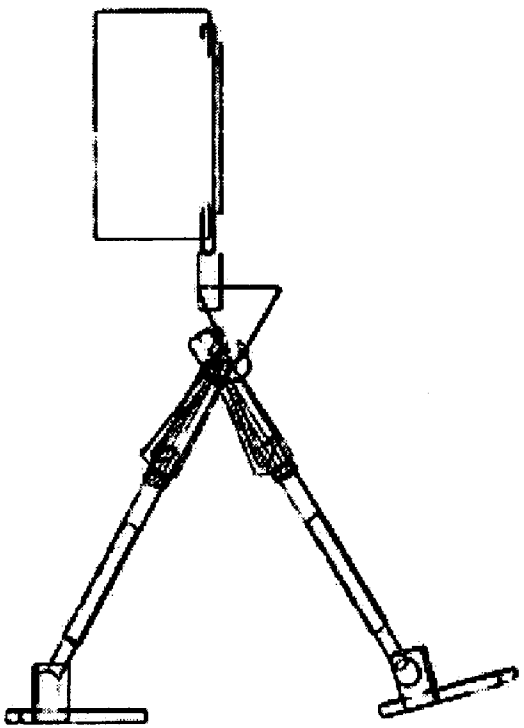
FIG. 21B is an illustration of the passive exoskeleton in the position shown in FIG. 21A, without the user.
Figure 21A:
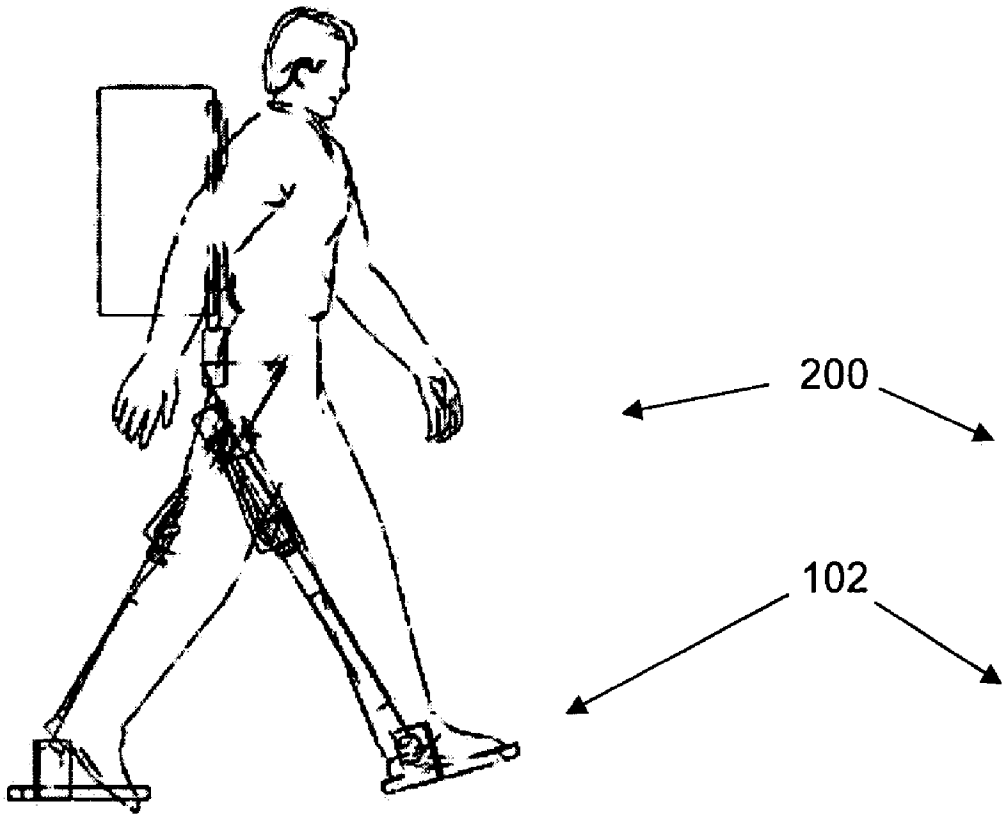
FIG. 21A is a side view illustration of a passive exoskeleton attached with a user, where a right leg of a user is in an initial contact of the stance phase.
Figure 22B:
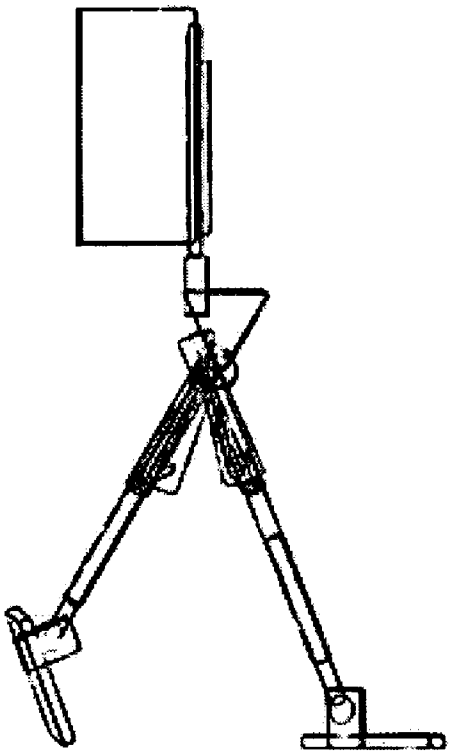
FIG. 22B is an illustration of the passive exoskeleton in the position shown in FIG. 22A, without the user.
Figure 22A:
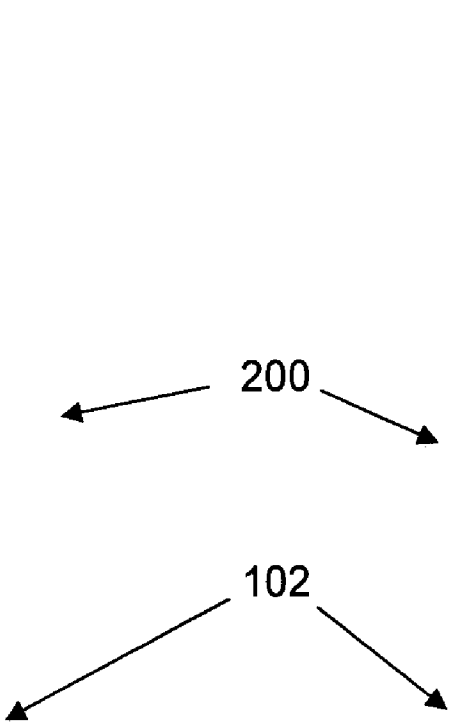
FIG. 22A is a side view illustration of a passive exoskeleton attached with a user, where a right leg of a user is in a loading response portion of the stance phase.
Figure 23B:
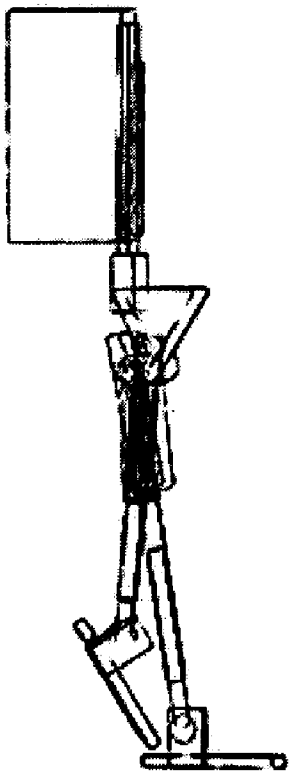
FIG. 23B is an illustration of the passive exoskeleton in the position shown in FIG. 23A, without the user.
Figure 23A:
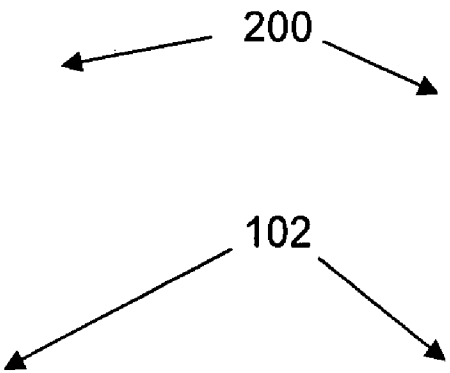
FIG. 23A is a side view illustration a passive exoskeleton attached with a user, where a right leg of a user is in a mid-stance of the stance phase.
Figure 23A:
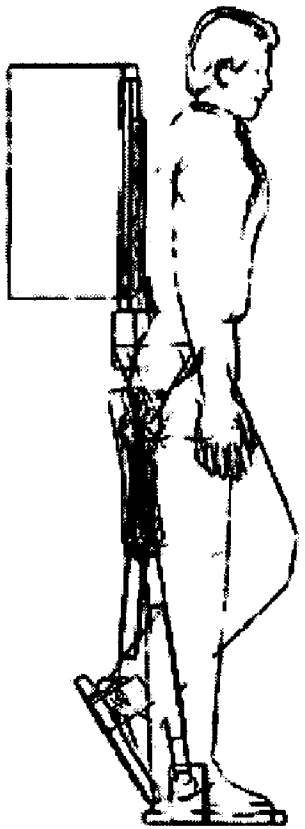
Figure 24B:
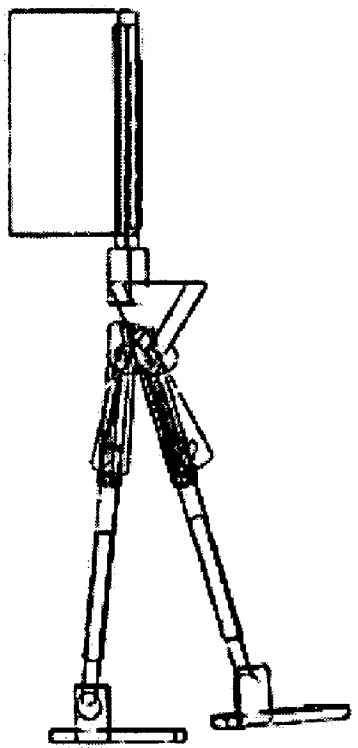
FIG. 24B is an illustration of the passive exoskeleton in the position shown in FIG. 24A, without the user.
Figure 24A:
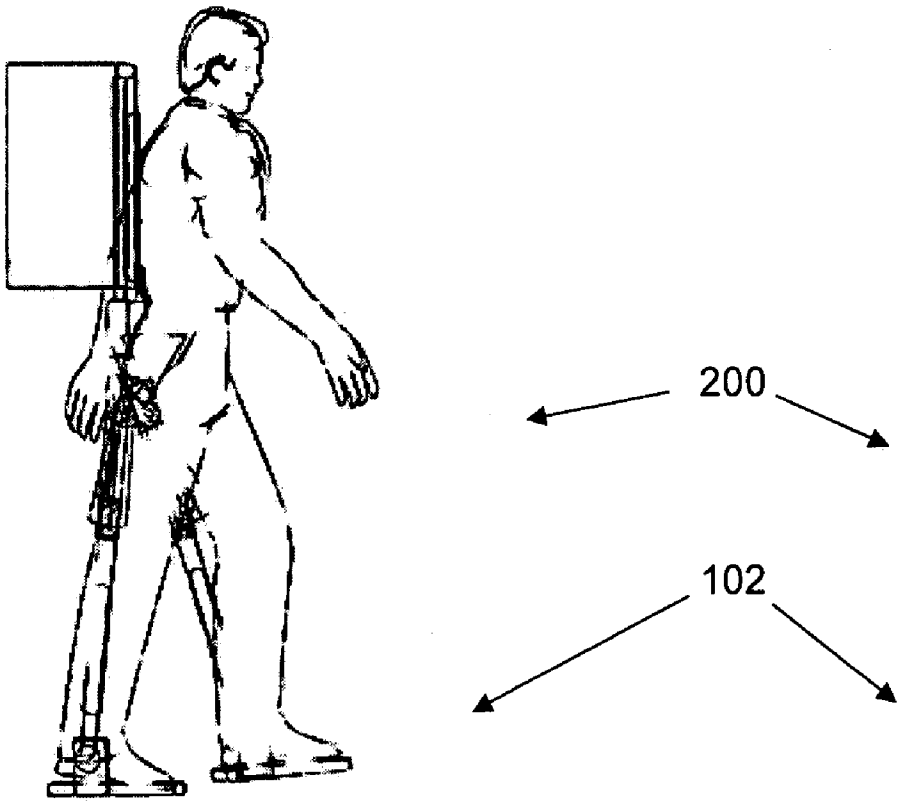
FIG. 24A is a side view illustration a passive exoskeleton attached with a user, where a right leg of a user is in a terminal stance of the stance phase.
Figure 25B:
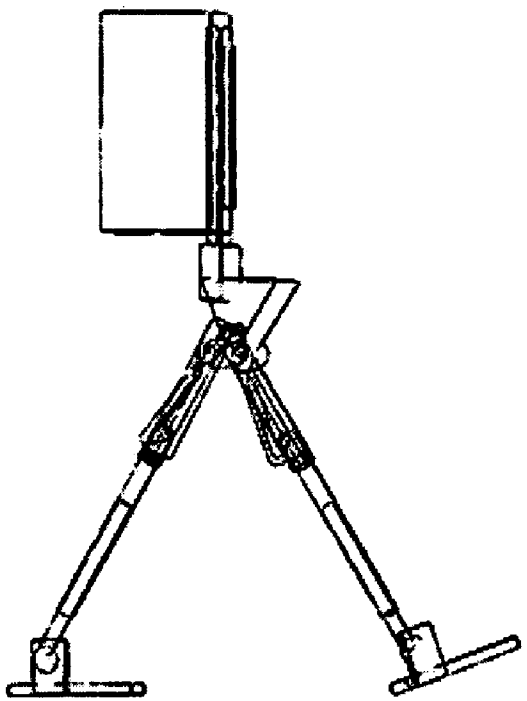
FIG. 25B is an illustration of the passive exoskeleton in the position shown in FIG. 25A, without the user.
Figure 25A:
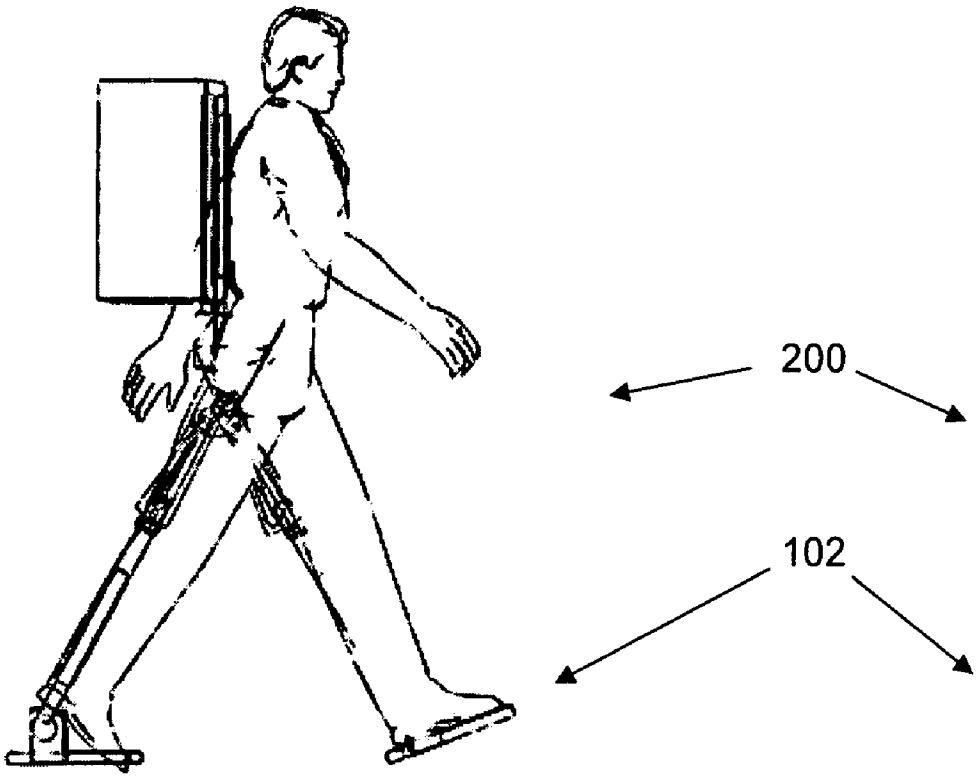
FIG. 25A is a side view illustration of a passive exoskeleton attached with a user, where a right leg of a user is in a pre-swing of the stance phase.
Figure 26B:
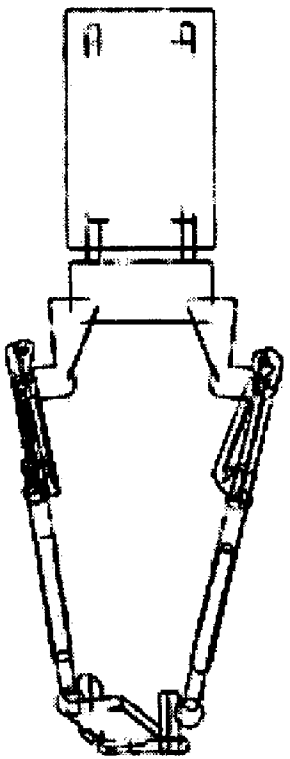
FIG. 26B is an illustration of the passive exoskeleton in the position shown in FIG. 26A, without the user.
Figure 26A:
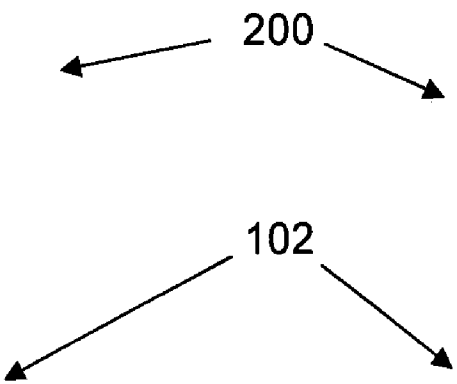
FIG. 26A is front view illustration of a passive exoskeleton attached with a user, where a right leg of a user is in an initial contact of the stance phase.
Figure 26A:
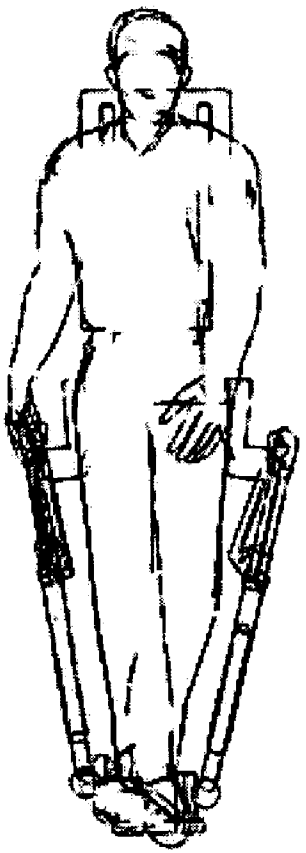
Figure 27B:
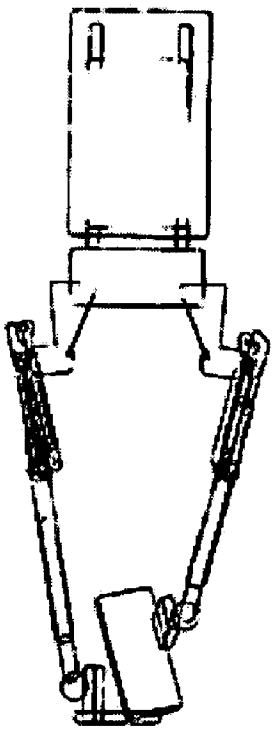
FIG. 27B is an illustration of the passive exoskeleton in the position shown in FIG. 27A, without the user.
Figure 27A:
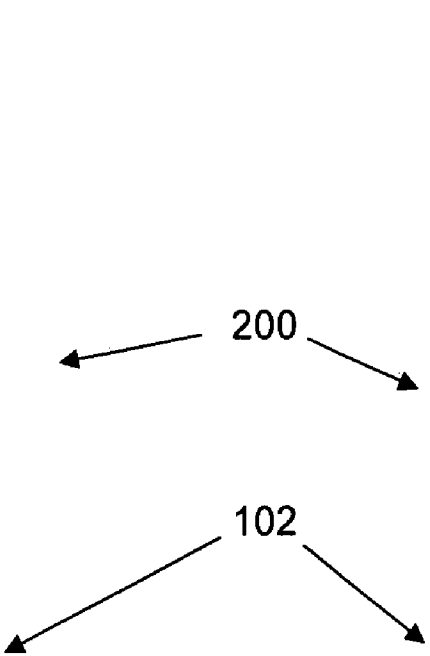
FIG. 27A is a front view illustration of a passive exoskeleton attached with a user, where a right leg of a user is in a loading response of the stance phase.
Figure 28B:
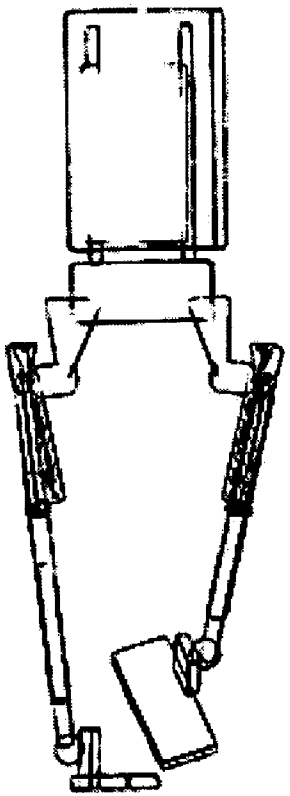
FIG. 28B is an illustration of the passive exoskeleton in the position shown in FIG. 28A, without the user.
Figure 28A:
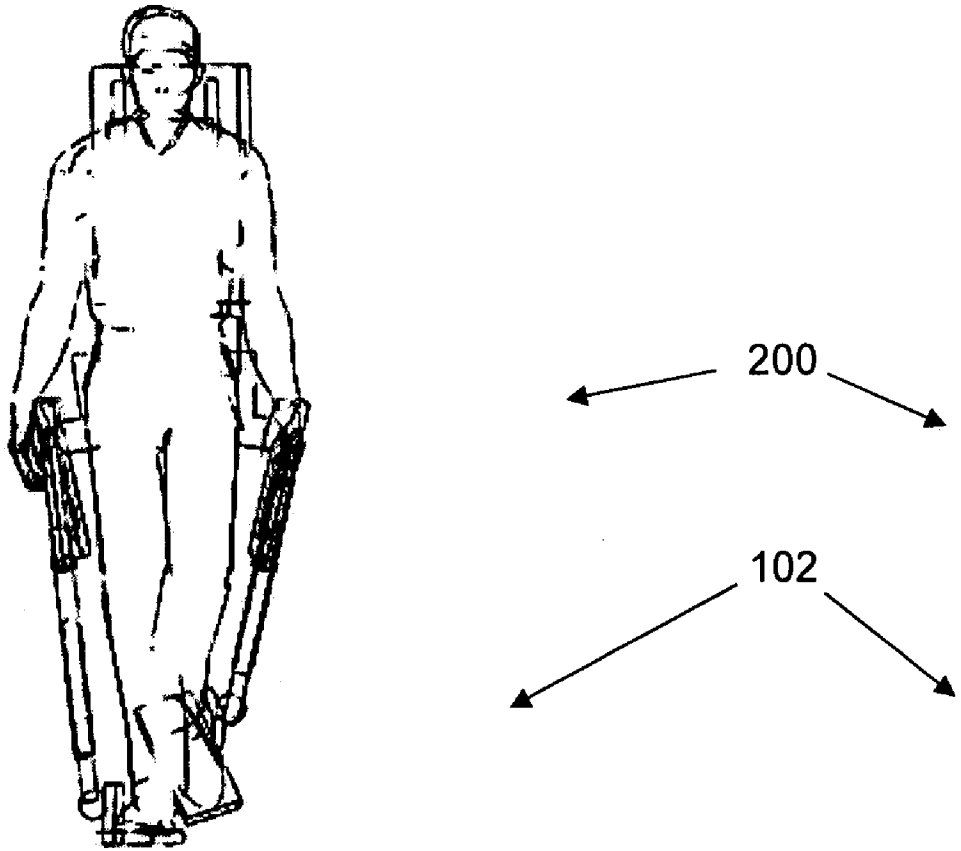
FIG. 28A is a front view illustration of a passive exoskeleton attached with a user, where a right leg of a user is in a mid-stance of the stance phase.
Figure 29B:
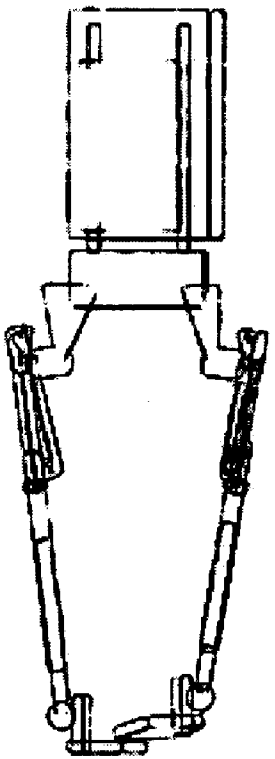
FIG. 29B is an illustration of the passive exoskeleton in the position shown in FIG. 29A, without the user.
Figure 29A:
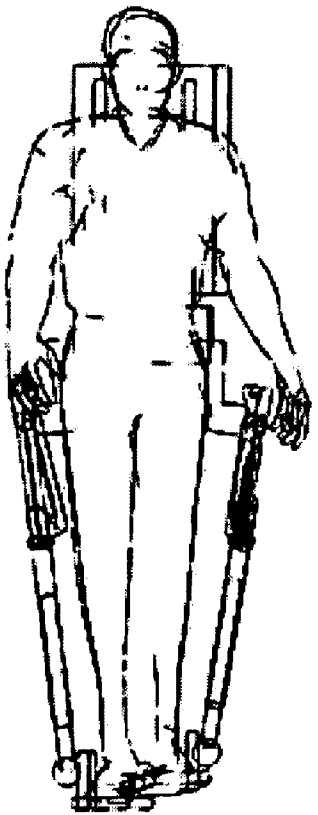
FIG. 29A is a front view of a passive exoskeleton attached with a user, where a right leg of a user is in a terminal-stance of the stance phase.
Figure 30B:
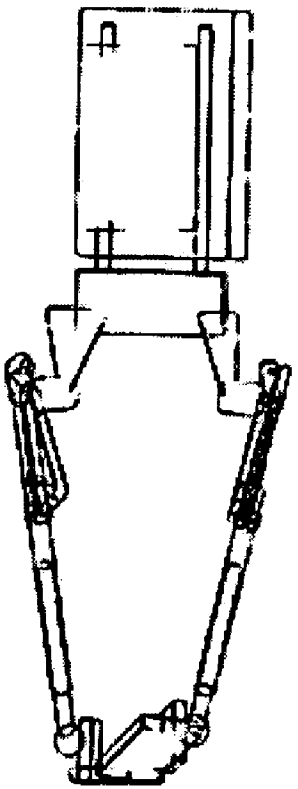
FIG. 30B is an illustration of the passive exoskeleton in the position shown in FIG. 30A, without the user.
Figure 30A:
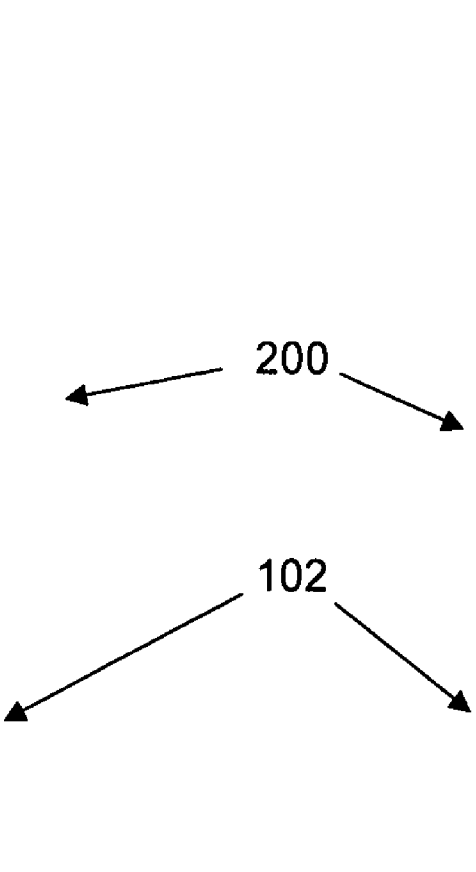
FIG. 30A is a side view illustration of a passive exoskeleton attached with a user, where a right leg of a user is in a pre-swing of the stance phase.
Figure 30A:
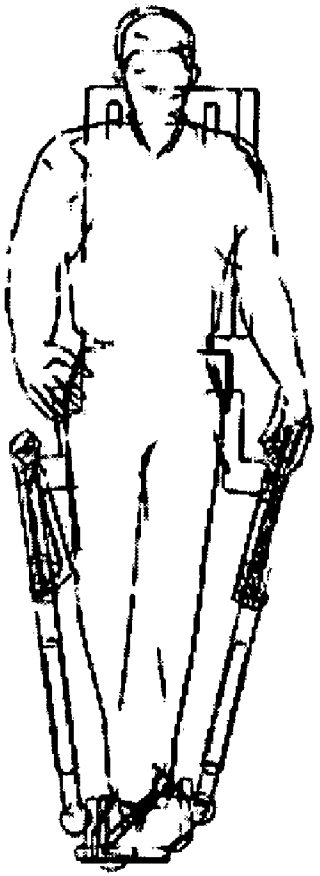

As shown in FIG. 12, before the end of the swing phase, the top component 328 hits the rear rocker stop 322. Any further motion of the leg forward 1000 causes the load pin 314 to move into and along the load channel 304, allowing the rocker 300 to take up the weight of the load after heel-strike 106.

FIGS. 13A through 20B are perspective view illustrations of a passive exoskeleton 200, both attached proximate a user (i.e., FIGS. 13A, 14A, 15A, 16A, 17A, 18A, 19A, and 20A) and without a user (i.e., FIGS. 13B, 14B, 15B, 16B, 17B, 18B, 19B, and 20B) as one side of the exoskeleton 200 travels through a stance phase 102 and thereafter a swing phase 104.

FIGS. 21A through 25B are side view illustrations of a passive exoskeleton 200, both attached proximate a user (i.e., FIGS. 21A, 22A, 23A, 24A, and 25A) and without a user (i.e., FIGS. 21B, 22B, 23B, 24B, and 25B) as one side of the exoskeleton 200 travels through a stance phase 102.

FIGS. 26A through 30B are front view illustrations of a passive exoskeleton 200, both attached proximate a user (i.e., FIGS. 26A, 27A, 28A, 29A, and 30A) and without a user (i.e., FIGS. 26B, 27B, 28B, 29B, and 30B) as one side of the exoskeleton 200 travels through a stance phase 102.

(ii) Reverse Motion

FIGS. 31A through 43B are side and top view illustrations of the rocker 300 and bias block 330 motion while a user is walking backwards 3104 (i.e., reverse motion). As shown in FIGS. 31A through 43B, the bias block 330 is added to divide the region between the two rocker stop 320/322 into five zones. The two rocker stops 320/322 represent two zones, allowing for give/compression. A quasi-equilibrium point 3100 represents a zone of division between the two divided zones 3102. The two divided zones 3102 represent the area between the rocker stops 320/322 and the quasi-equilibrium point 3100. The bias block 330 is curved, and aligned radially with the main pin (i.e., hip pin) so that the quasi-equilibrium point 3100 is aligned such that when loaded, the user's posture at rest when both feet are close together (i.e., standing) positions the rocker 300 and the bias block 330 in the quasi-equilibrium position 3100.

Also, the bias block 330 functions in the two divided zones 3102 between the rocker stops 320/322. A user wearing the exoskeleton can walk backwards 3104 when the bias block 330 is engaged, provided the user takes a smaller stride backwards 3104 than the rocker stops 320/322 are set for forward 3106 motion.

Also, as noted in FIGS. 31A through 43B, the spring force of the pressure mechanism 332 is represented by an arrow 3108. Although not to scale, the size of the arrow 3108 is proportional to the amount of force on the bias block 330.

Figures 31A, 31B:
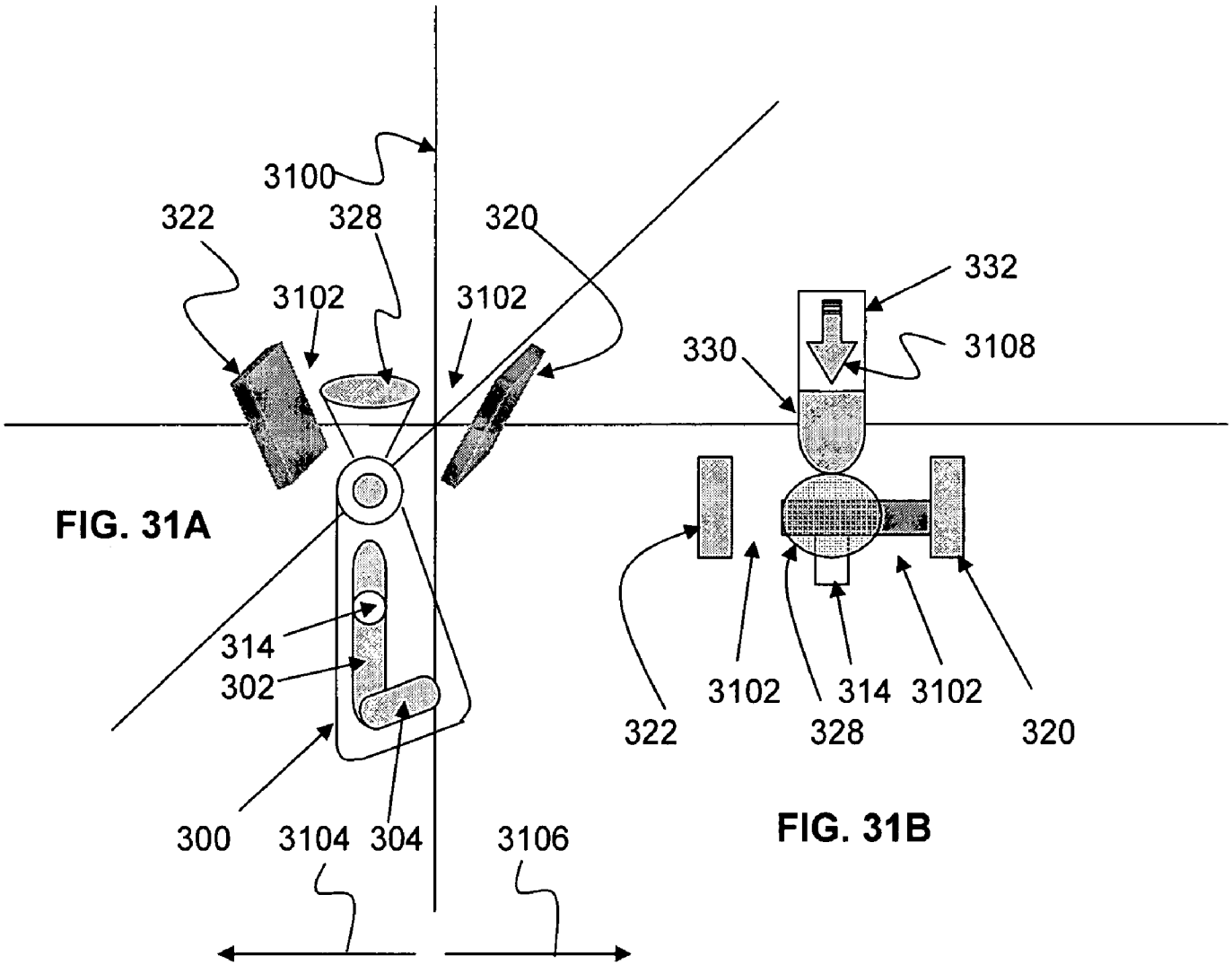
FIG. 31A is a side view illustration of a rocker according to the present invention, shown in a recovery phase.
FIG. 31B is a top view illustration of the rocker of FIG. 31A, engaging with a bias block according to the present invention.

FIGS. 31A and 31B are side and top view illustrations of the rocker 300 and bias block 330 in a default quasi-equilibrium position. As shown, the load pin 314 is in the travel channel 302. The quasi-equilibrium position generally occurs during the recovery phase, when the foot is off of the ground. FIG. 31A is a side view of the rocker 300, while FIG. 31B is a top view of the rocker 300 and bias block 330.

Figures 32A, 32B:
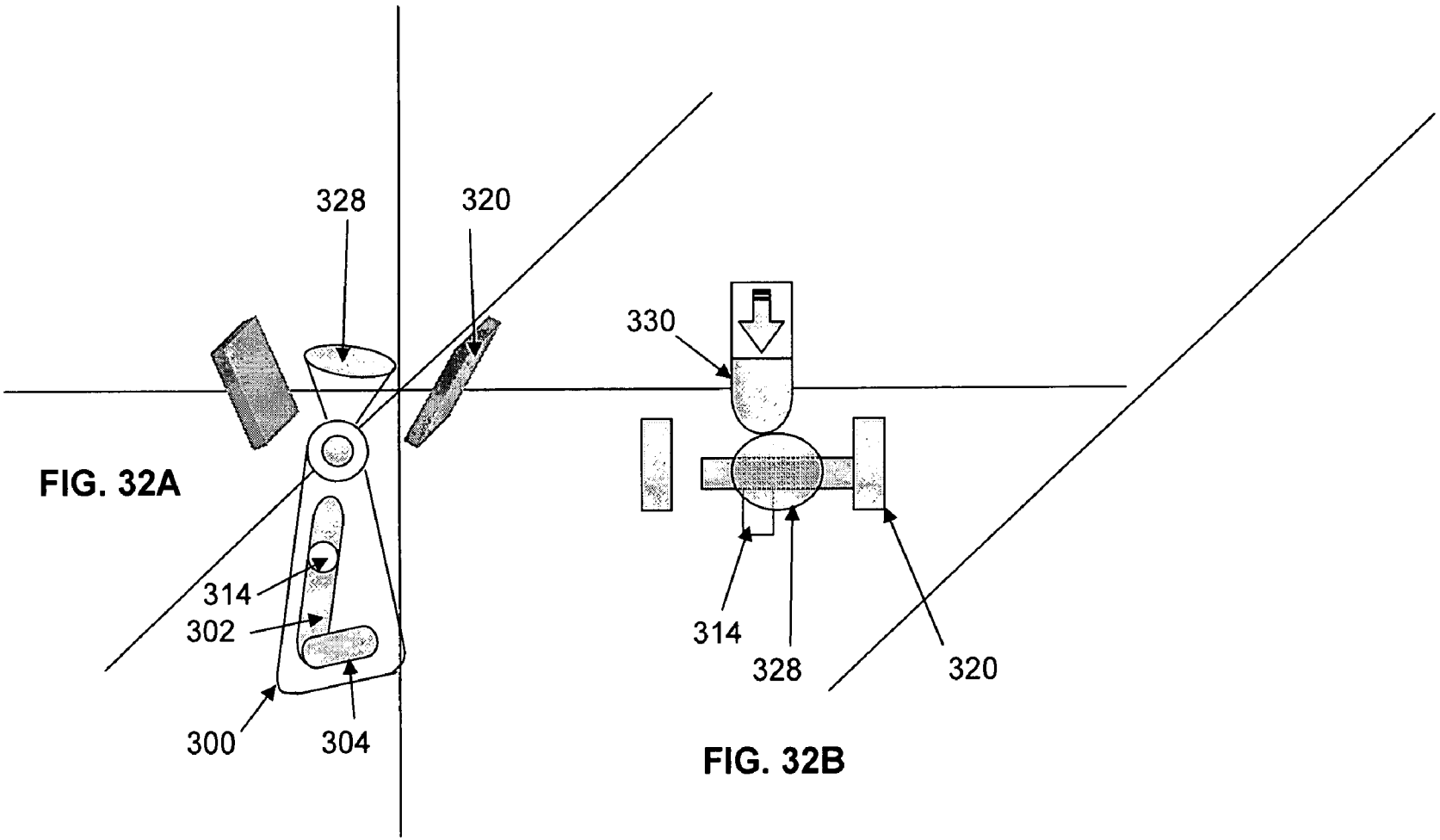
FIG. 32A is a side view illustration of a rocker according to the present invention, shown in the recovery phase.
FIG. 32B is a top view illustration of the rocker of FIG. 32A, engaging with a bias block according to the present invention.

FIGS. 32A and 32B are side and top view illustrations of the rocker 300 and the bias block 330 as a user begins a backward step during the recovery phase (i.e., with the foot off of the ground). As shown, the load pin 314 is still in the travel channel 302 as the bias block 330 begins exerting pressure against the top component 328 of the rocker 330, thereby forcing the top component 328 toward the front rocker stop 320. FIG. 32A is a side view of the rocker 300, while FIG. 32B is a top view of the rocker 300 and bias block 330.

Figures 33A, 33B:
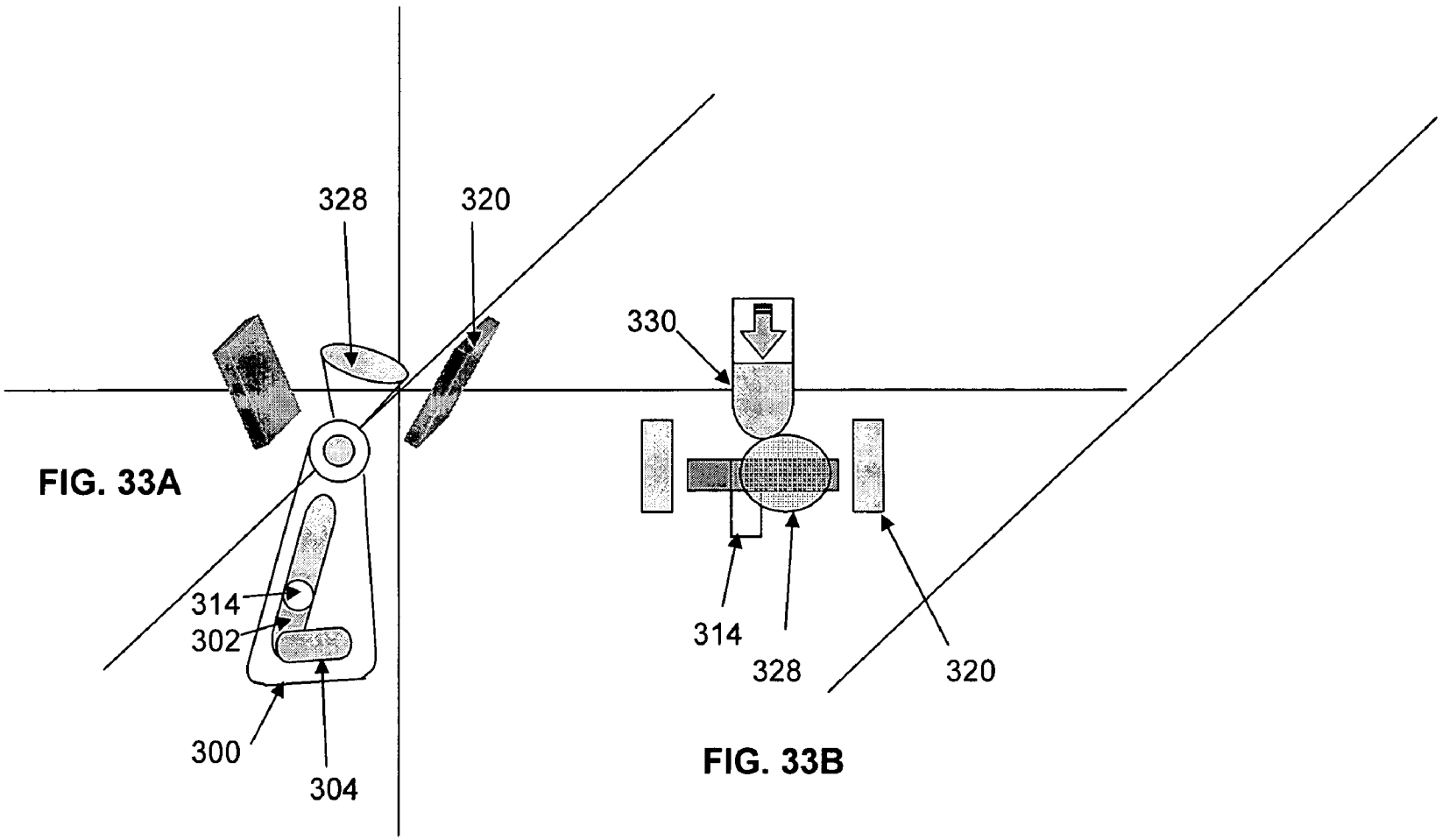
FIG. 33A is a side view illustration of a rocker according to the present invention, shown in the recovery phase.
FIG. 33B is a top view illustration of the rocker of FIG. 33A, engaging with a bias block according to the present invention.

FIGS. 33A and 33B are side and top view illustrations of the rocker 300 and the bias block 330 during a backward step extension of the recovery phase (i.e., with the foot still off of the ground). As shown, the load pin 314 is still in the travel channel 302 as the bias block 330 continues exerting pressure against the top component 328 of the rocker 330, thereby forcing the top component 328 toward the front rocker stop 320. FIG. 33A is a side view of the rocker 300, while FIG. 33B is a top view of the rocker 300 and bias block 330.

Figures 34A, 34B:
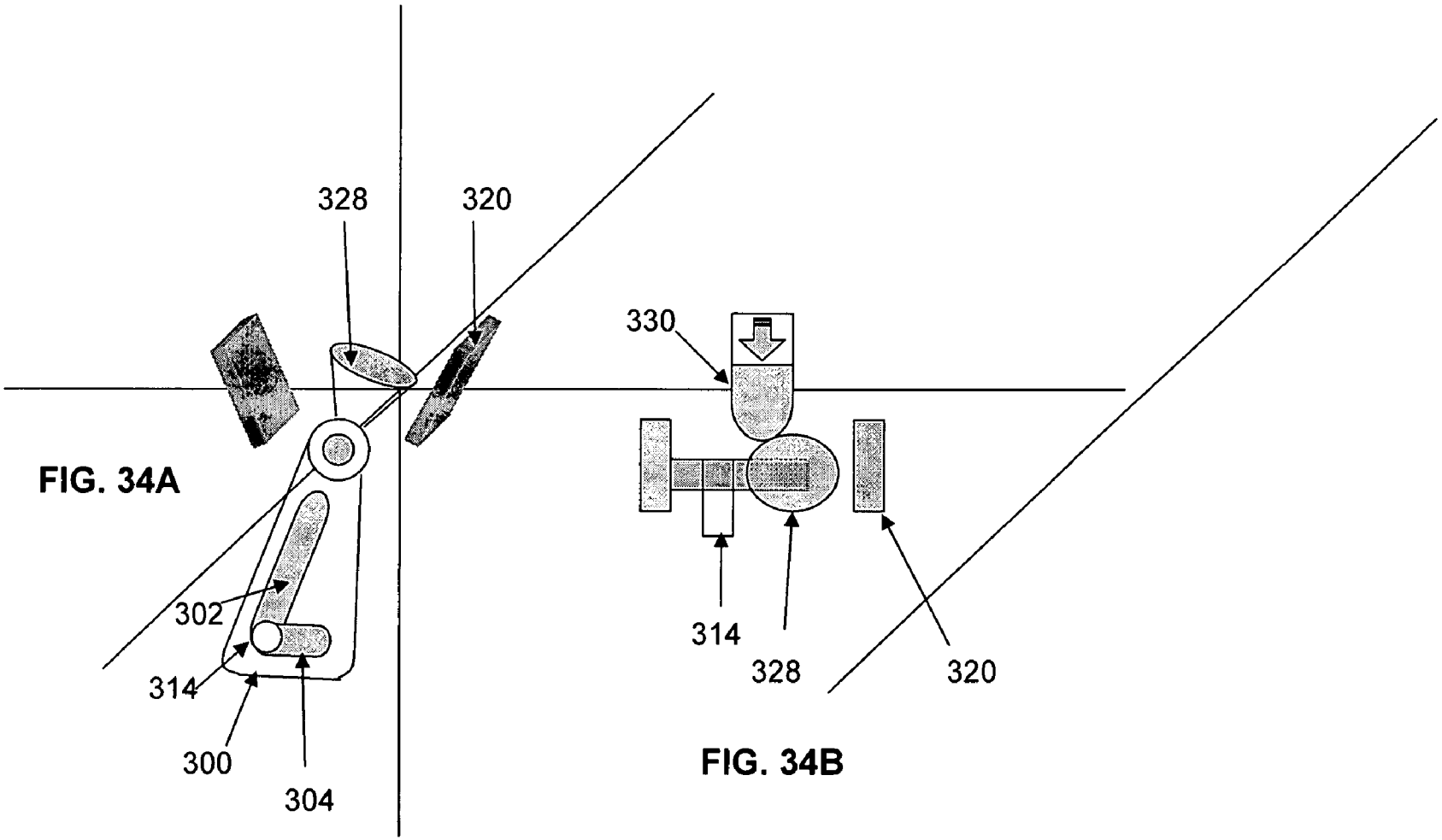
FIG. 34A is a side view illustration of a rocker according to the present invention, showing a transition from the recovery phase to a stance phase.
FIG. 34B is top view illustration of the rocker of FIG. 34A, engaging with a bias block according to the present invention.

FIGS. 34A and 34B are side and top view illustrations of the rocker 300 and the bias block 330 during a backward step as the foot has just touched the ground (i.e., transition to stance phase). As shown, the load pin 314 is at the intersection of the travel channel 302 and the load channel 304, with the bias block 330 continuing to exert pressure against the top component 328 of the rocker 330, thereby forcing the top component 328 toward the front rocker stop 320 and the load pin 314 into the load channel 304. FIG. 34A is a side view of the rocker 300, while FIG. 34B is a top view of the rocker 300 and bias block 330.

Figures 35A, 35B:
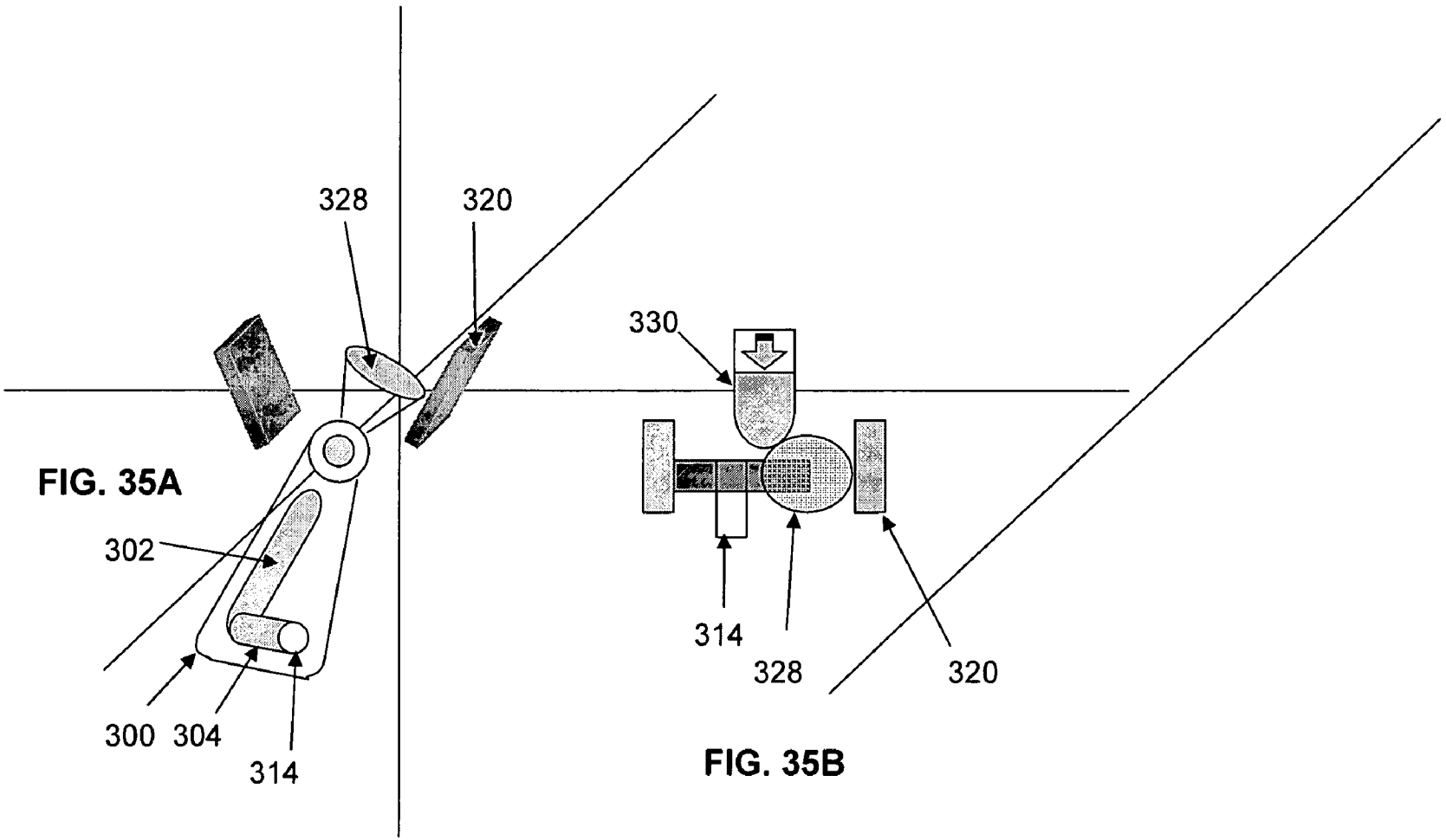
FIG. 35A is a side view of illustration of a rocker according to the present invention, shown in the stance phase.
FIG. 35B is a top view illustration of the rocker of FIG. 35A, engaging with a bias block according to the present invention.

FIGS. 35A and 35B are side and top view illustrations of the rocker 300 and the bias block 330 during a stance phase of the backward step with the foot on the ground. As shown, the load pin 314 is in the load channel 304. FIG. 35A is a side view of the rocker 300, while FIG. 35B is a top view of the rocker 300 and bias block 330.

Figures 36A, 36B:
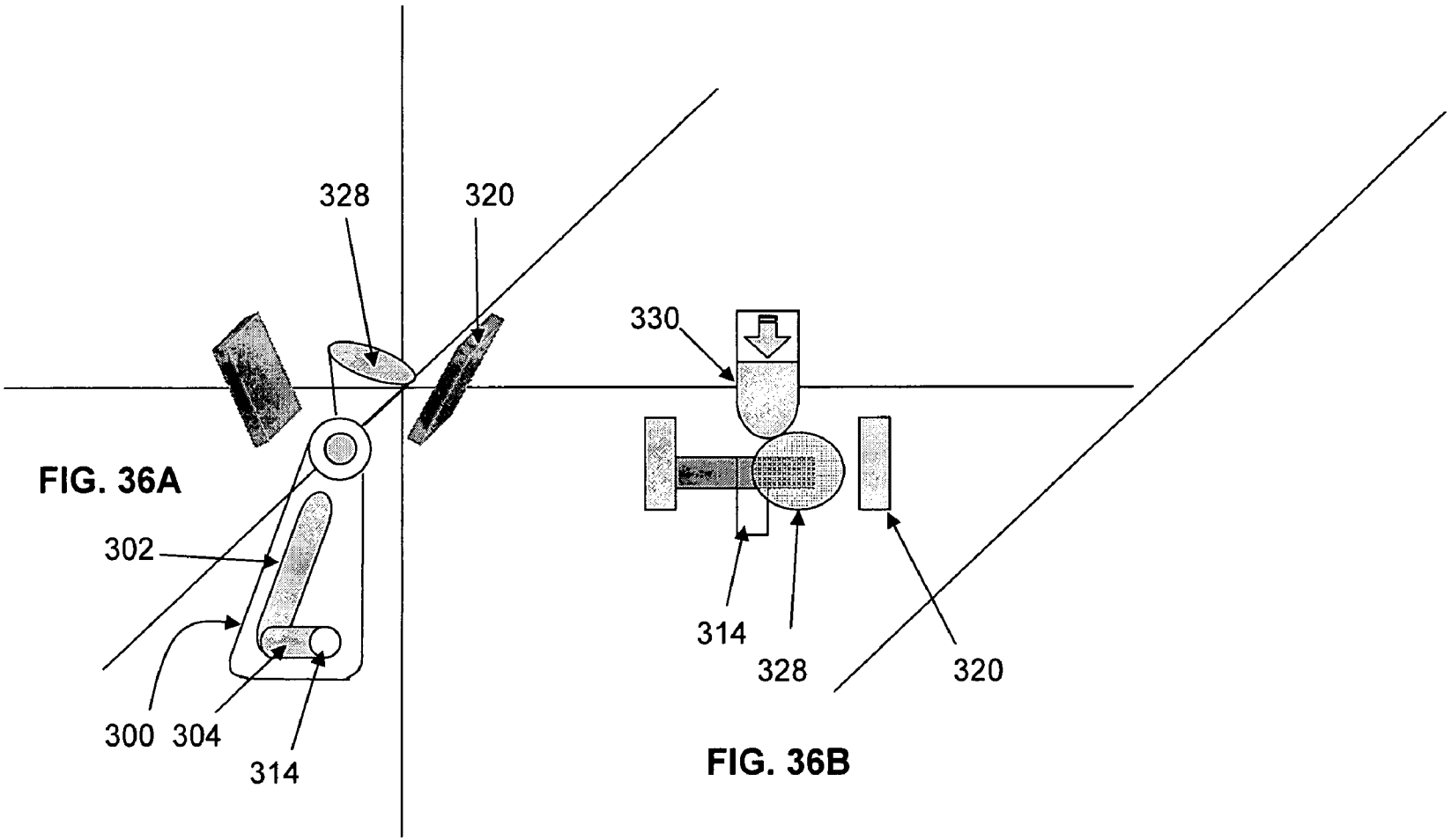
FIG. 36A is a side view illustration of a rocker according to the present invention, shown in the stance phase.
FIG. 36B is a top view illustration of the rocker of FIG. 36A, engaging with a bias block according to the present invention.

FIGS. 36A and 36B are side and top view illustrations of the rocker 300 and the bias block 330 during a furtherance of the backward step stance phase with the foot still on the ground. As shown, the load pin 314 is still in the load channel 304. FIG. 36A is a side view of the rocker 300, while FIG. 36B is a top view of the rocker 300 and bias block 330.

Figures 37A, 37B:
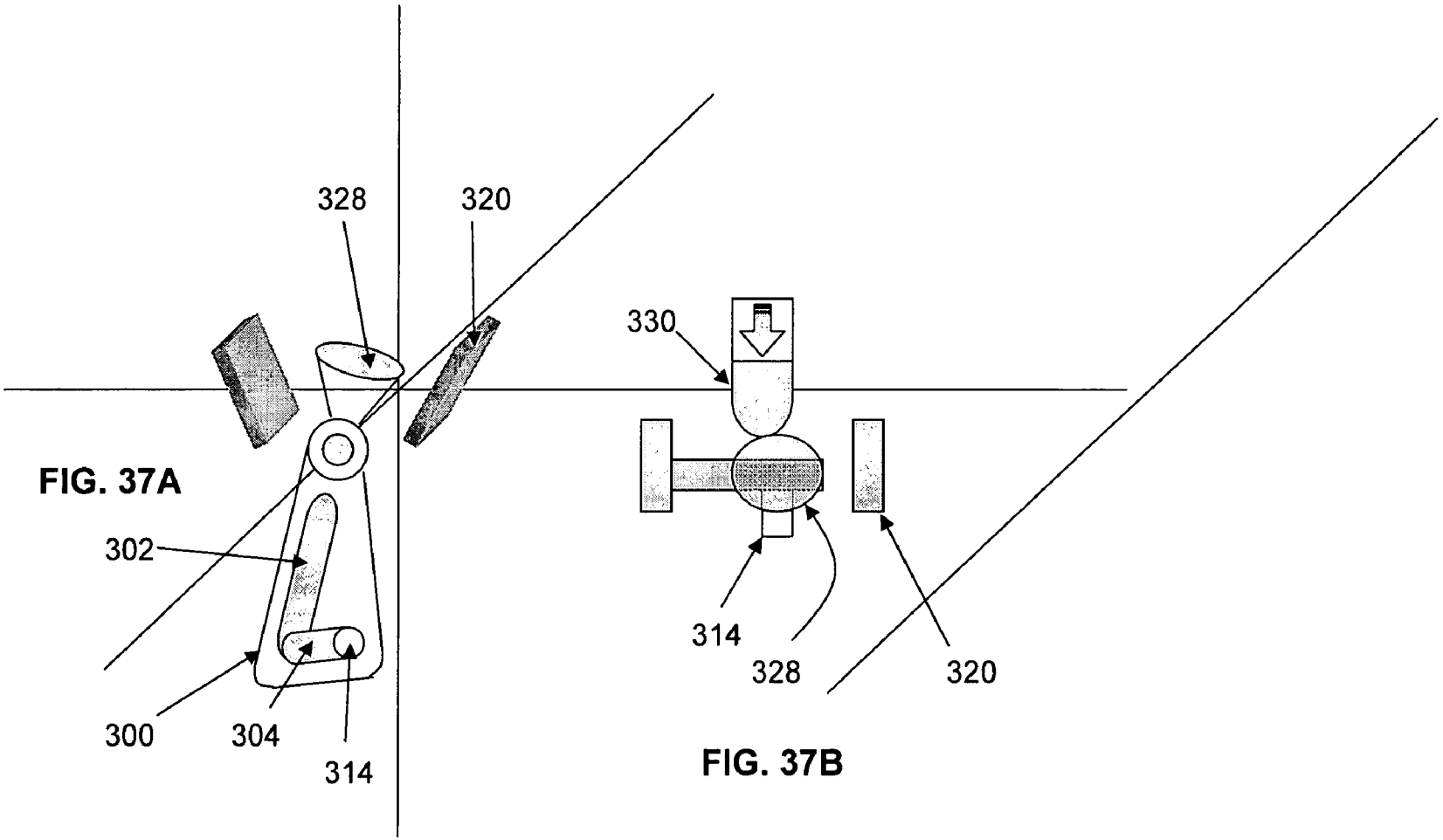
FIG. 37A is a side view illustration of a rocker according to the present invention, shown in the stance phase.
FIG. 37B is a top view illustration of the rocker of FIG. 37A, engaging with a bias block according to the present invention.

FIGS. 37A and 37B are side and top view illustrations of the rocker 300 and the bias block 330 during a furtherance of the backward step stance phase with the foot still on the ground. As shown, the load pin 314 is still in the load channel 304. FIG. 37A is a side view of the rocker 300, while FIG. 37B is a top view of the rocker 300 and bias block 330.

Figures 38A, 38B:
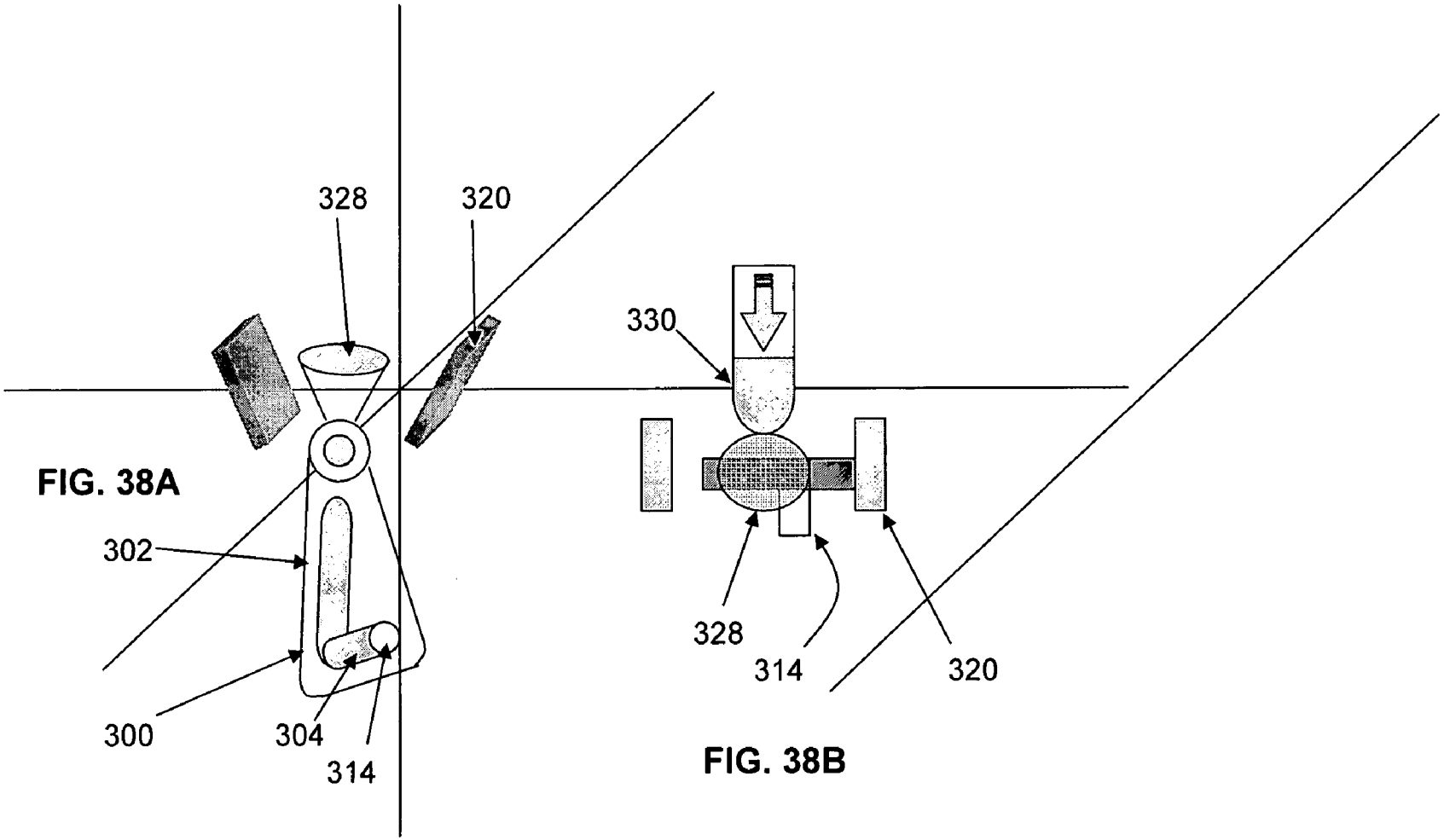
FIG. 38A is a side view illustration of a rocker according to the present invention, shown in the stance phase.
FIG. 38B is a top view illustration of the rocker of FIG. 38A, engaging with a bias block according to the present invention.

FIGS. 38A and 38B are side and top view illustrations of the rocker 300 and the bias block 330 during a furtherance of the backward step stance phase with the foot still on the ground. As shown, the load pin 314 is still in the load channel 304. FIG. 38A is a side view of the rocker 300, while FIG. 38B is a top view of the rocker 300 and bias block 330.

Figures 39A, 39B:
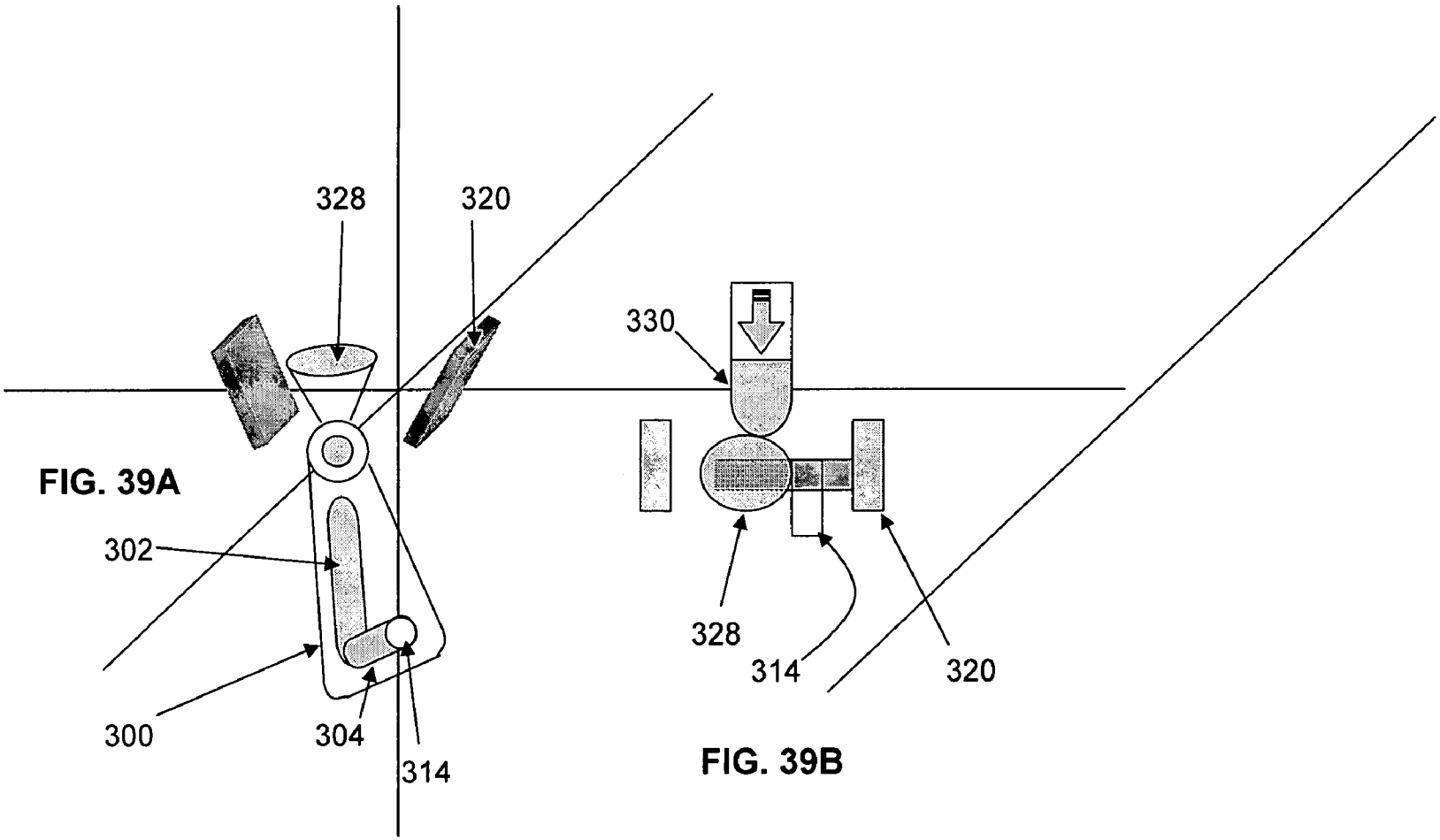
FIG. 39A is a side view illustration of a rocker according to the present invention, shown in the stance phase.
FIG. 39B is a top view illustration of the rocker of FIG. 39A, engaging with a bias block according to the present invention.

FIGS. 39A and 39B are side and top view illustrations of the rocker 300 and the bias block 330 during a furtherance of the backward step stance phase with the foot still on the ground. As shown, the load pin 314 is still in the load channel 304, while the top component 328 of the rocker 300 passes the quasi-equilibrium point. FIG. 39A is a side view of the rocker 300, while FIG. 39B is a top view of the rocker 300 and bias block 330.

Figures 40A, 40B:
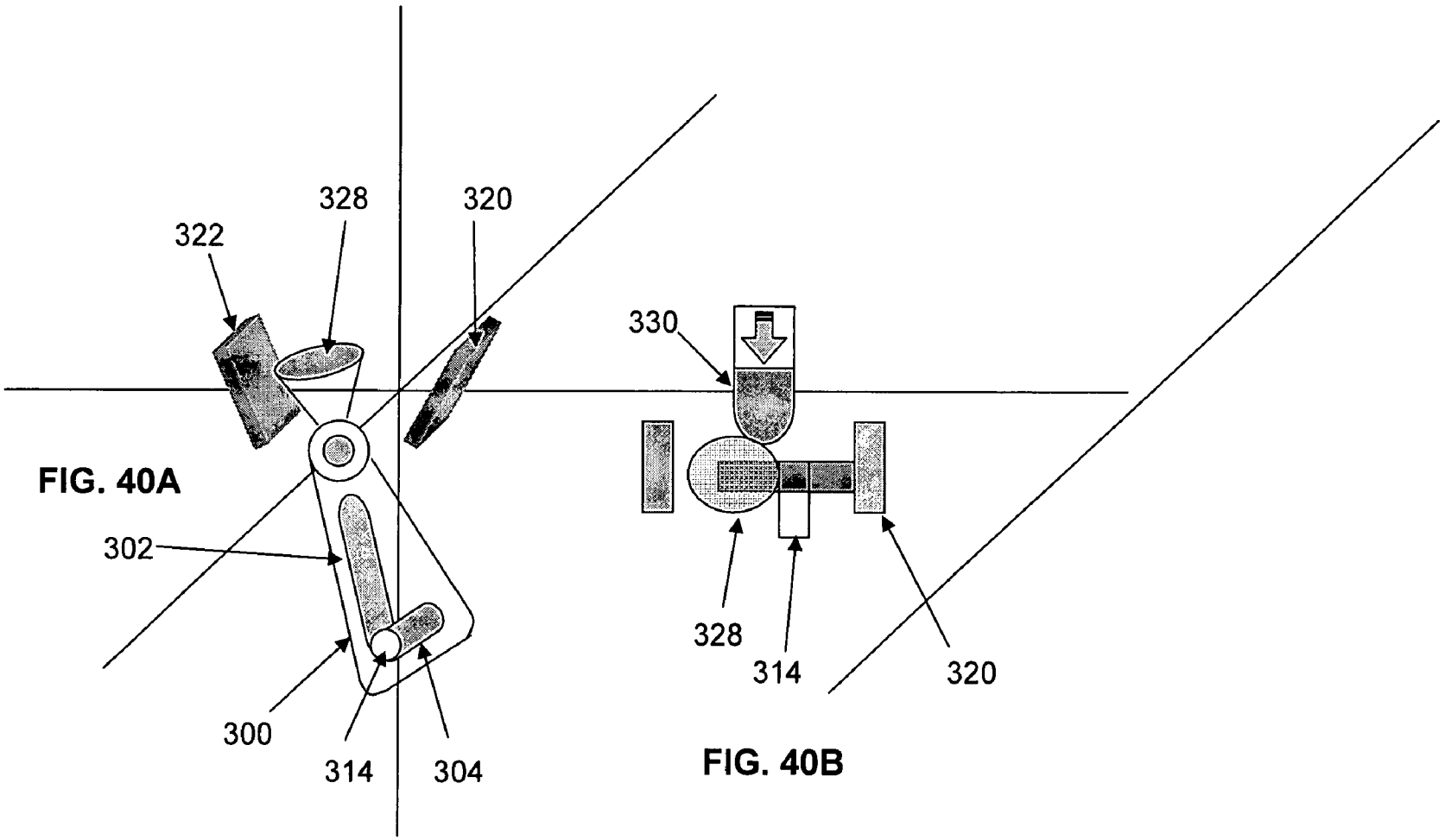
FIG. 40A is a side view illustration of a rocker according to the present invention, showing a transition from the stance phase to a swing phase.
FIG. 40B is a top view illustration of the rocker of FIG. 40A, engaging with a bias block according to the present invention.

FIGS. 40A and 40B are side and top view illustrations of the rocker 300 and the bias block 330 during a backward step as the foot still touches the ground but is no longer loaded (i.e., transition to swing phase). As shown, the load pin 314 is at the intersection of the travel channel 302 and the load channel 304, with the bias block 330 exerting pressure against the top component 328 of the rocker 330, thereby forcing the top component 328 toward the rear rocker stop 322 and the load pin 314 toward the intersection of the load channel 304 and travel channel 302. FIG. 40A is a side view of the rocker 300, while FIG. 40B is a top view of the rocker 300 and bias block 330.

Figures 41A, 41B:
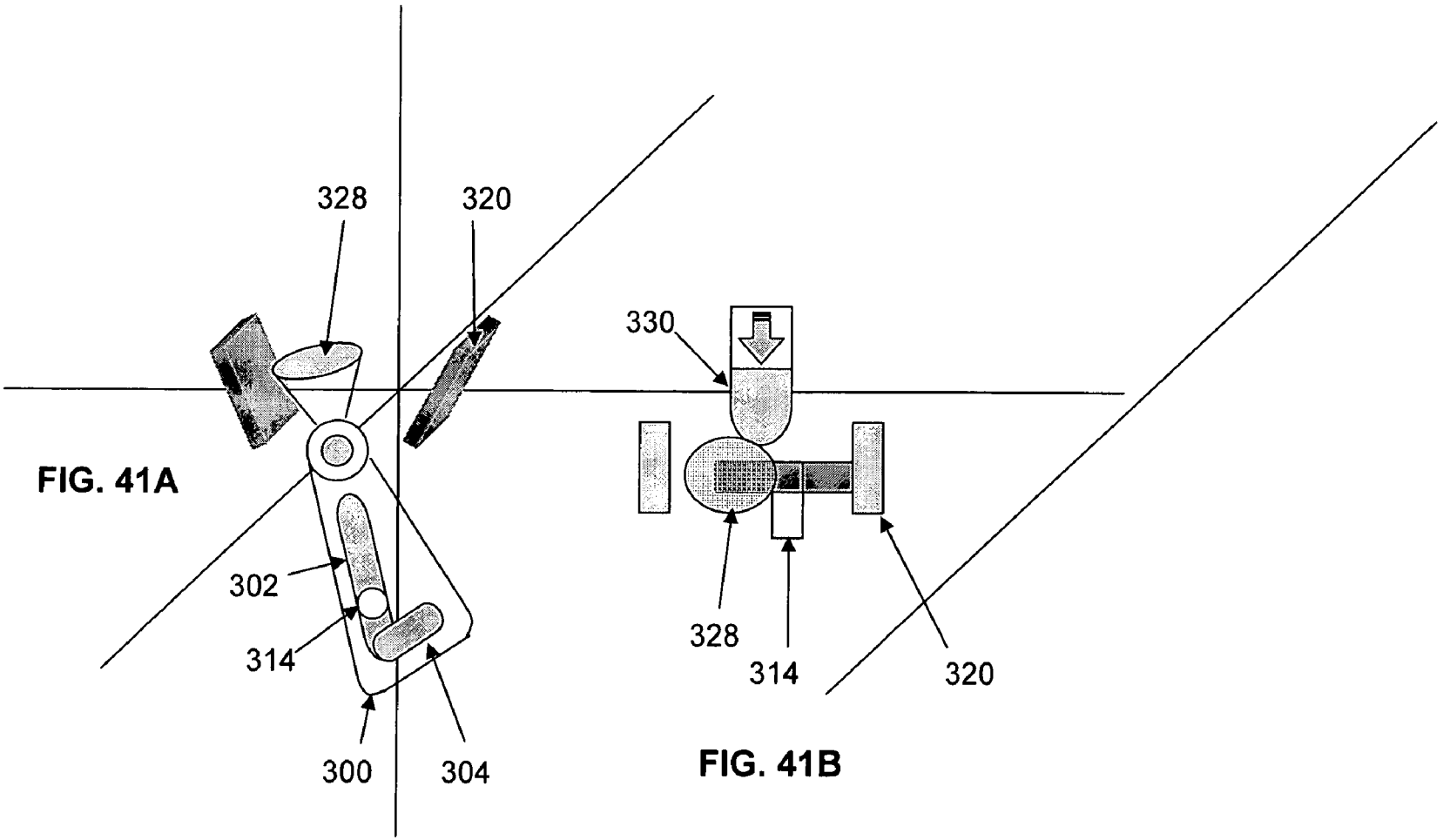
FIG. 41A is a side view illustration of a rocker according to the present invention, shown in the swing phase.
FIG. 41B is a top view illustration of the rocker of FIG. 41A, engaging with a bias block according to the present invention.

FIGS. 41A and 41B are side and top view illustrations of the rocker 300 and the bias block 330 during a furtherance of the backward step swing phase with the foot no longer touching the ground (i.e., in the air). As shown, the load pin 314 has shifted into the travel channel 302, while the top component 328 of the rocker 300 begins returning toward the quasi-equilibrium point. FIG. 41A is a side view of the rocker 300, while FIG. 41B is a top view of the rocker 300 and bias block 330.

Figures 42A, 42B:
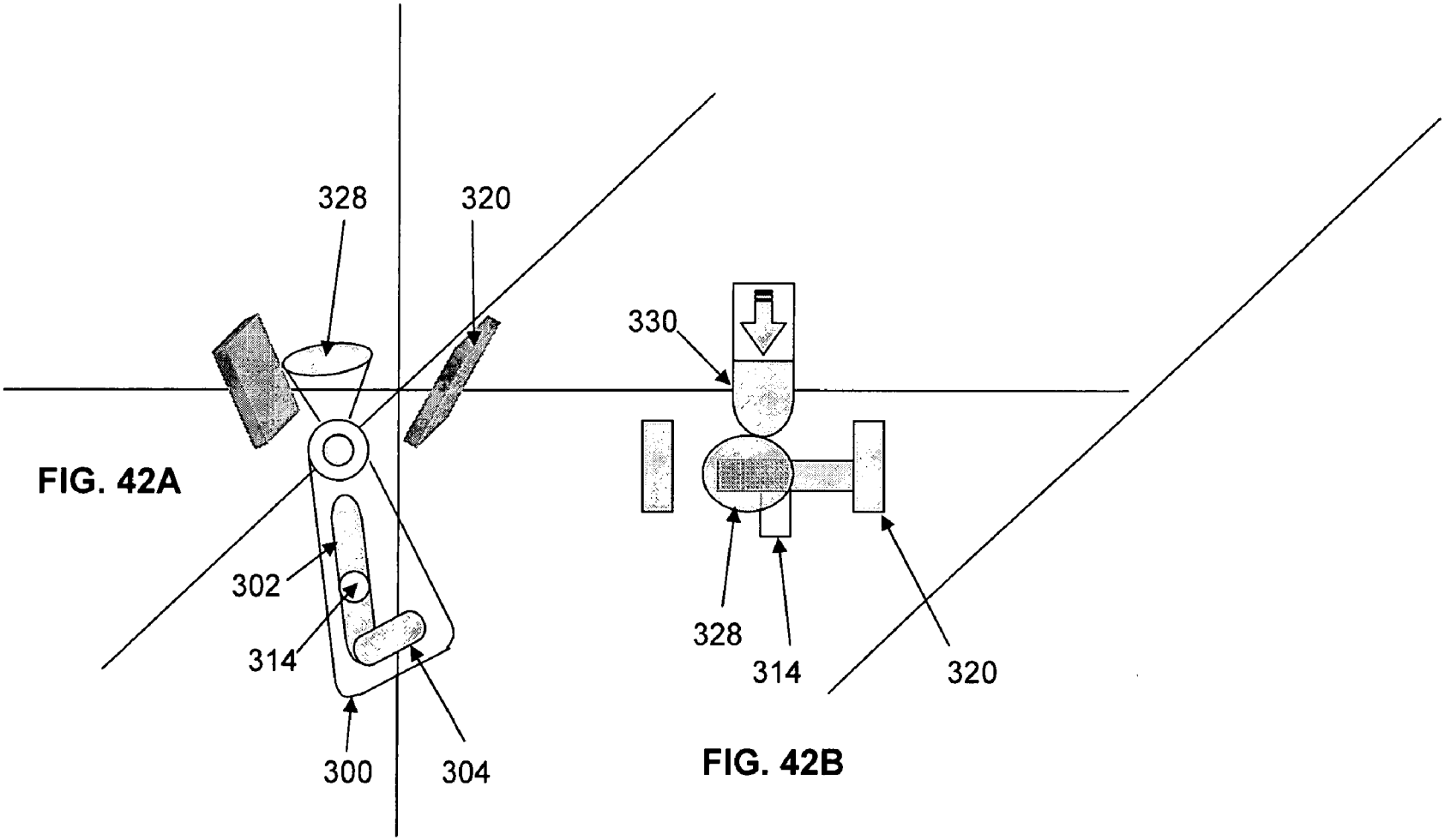
FIG. 42A is a side view illustration of a rocker according to the present invention, shown in the swing phase.
FIG. 42B is a top view illustration of the rocker of FIG. 42A, engaging with a bias block according to the present invention.

FIGS. 42A and 42B are side and top view illustrations of the rocker 300 and the bias block 330 during a furtherance of the backward step swing phase with the foot still in the air. As shown, the load pin 314 is in the travel channel 302, while the top component 328 of the rocker 300 continues returning mid-stance the quasi-equilibrium point. FIG. 42A is a side view of the rocker 300, while FIG. 42B is a top view of the rocker 300 and bias block 330.

Figures 43A, 43B:
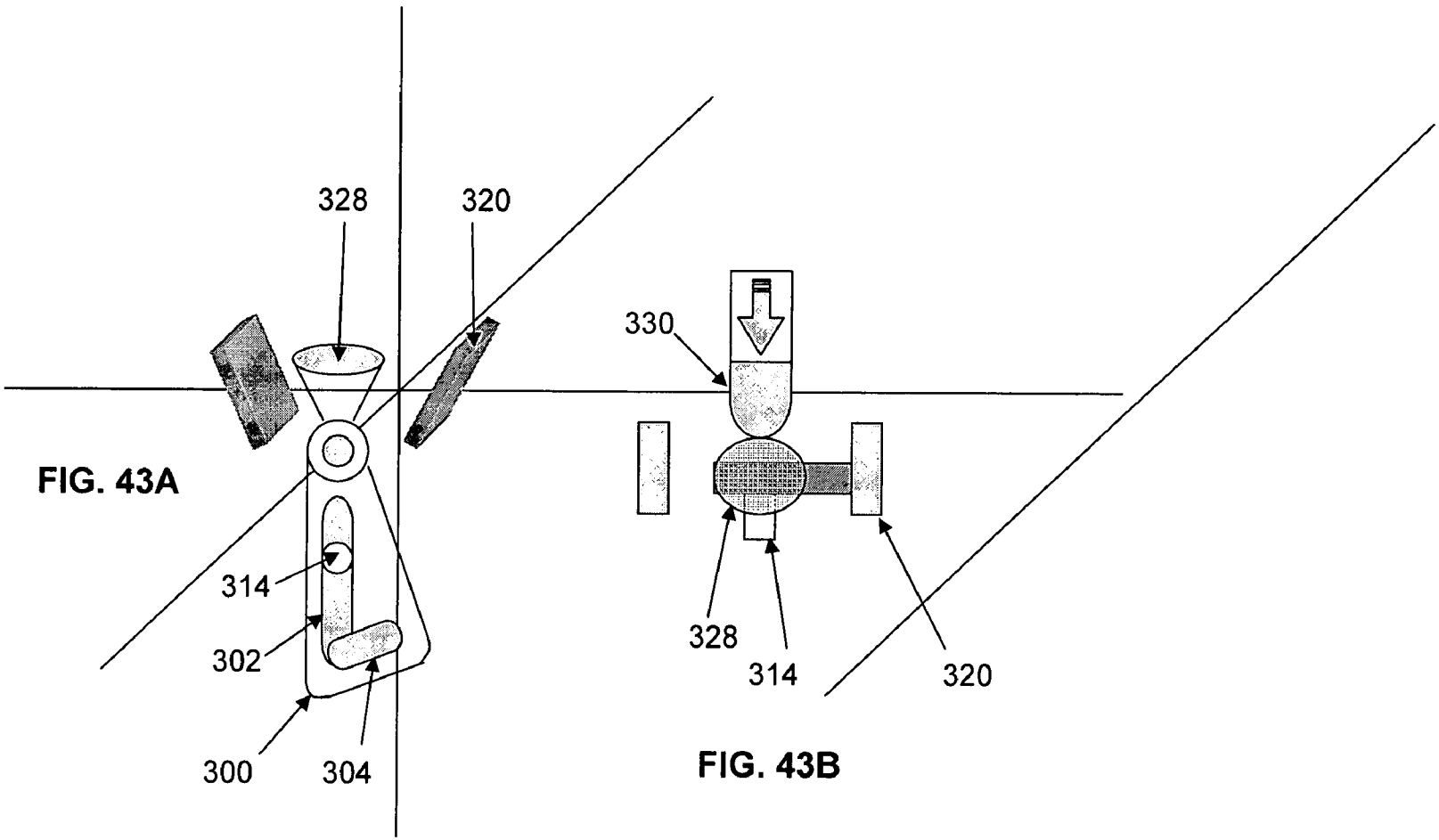
FIG. 43A is a side view illustration of a rocker according to the present invention, shown in a recovery phase after the rocker has returned to a quasi-equilibrium position.
FIG. 43B is top view illustration of the rocker of FIG. 43A, engaging with a bias block according to the present invention.

FIGS. 43A and 43B are side and top view illustrations of the rocker 300 and bias block 330 after having returned to the default quasi-equilibrium position during the recovery phase, with the foot still off of the ground. As shown, the load pin 314 is still in the travel channel 302. FIG. 43A is a side view of the rocker 300, while FIG. 43B is a top view of the rocker 300 and bias block 330.

As mentioned previously, motion of the bias block was illustrated herein during backward motion. However, and as can be appreciated by on in the art, the motion of the bias block is not limited to backward motion and operates in a similar fashion while a user is traveling forward.

What is claimed is:

1. A passive exoskeleton for aiding a user in bearing a load, the passive exoskeleton comprising:

a rocker for attaching with a body member, the rocker having a travel channel and a load channel incorporated therein, the travel channel being an elongated channel oriented directionally from proximate the body member to a ground surface, and the load channel formed as an elongated channel and positioned such that an angle between the load channel and the travel channel is less than ninety degrees, both the load channel and the travel channel formed to accommodate a load pin, the rocker also including a top component;

a bias block for attaching with the body member and for engaging with the top component of the rocker, both the bias block and the top component of the rocker are formed in such a manner that as a user walks and shifts between a swing phase and a stance phase, the top component of the rocker passes a point of equilibrium where the bias block turns the rocker to aid the load pin in transferring between the load channel and travel channel, thereby shifting the load from the rocker onto the load pin and ultimately to a ground surface, causing the passive exoskeleton to support at least a portion of the load.

2. A passive exoskeleton as set forth in claim 1, further comprising a body member for attaching proximate a portion of a user's body, with the rocker pivotally attached with the body member.

3. A passive exoskeleton as set forth in claim 2, further comprising a sliding rod attached with the body member.

4. A passive exoskeleton as set forth in claim 3, further comprising a load pin attached with the sliding rod and operably attached with the rocker through both the travel channel and the load channel, formed such that as a user walks and shifts from a swing phase to a stance phase, the load is transferred from the body member to the rocker, the shift causing the load pin to travel between the travel channel and the load channel, with weight from the load being transferred from the load channel to the load pin and the sliding rod, and thereafter through the sliding rod and ultimately a ground surface, causing the passive exoskeleton to support at least a portion of the load.

5. A passive exoskeleton as set forth in claim 4, further comprising a ground surface engage-able foot analog attached with the sliding rod, whereby weight from the load is transferred from the sliding rod to the foot analog and ultimately a ground surface, causing the passive exoskeleton to support at least a portion of the load.

6. A passive exoskeleton as set forth in claim 5, further comprising a pressure mechanism attached with the bias block for forcing the bias block against the top component of the rocker, thereby aiding the bias block in turning the rocker after the top component of the rocker passes the point of equilibrium.

7. A passive exoskeleton as set forth in claim 6, wherein the pressure mechanism is selected from a group consisting of a spring and hydraulics.

8. A passive exoskeleton as set forth in claim 7, further comprising a neutral block attached with the passive exoskeleton, the neutral block formed in such a manner that it is engage-able with the rocker to prevent the rocker from moving, such that when engaged with the rocker and when the load pin is in the travel channel, the load pin is maintained in the travel channel and is unable to transfer to the load channel, thereby causing the user to bear the full weight of the load.

9. A passive exoskeleton as set forth in claim 8, wherein the sliding rod further comprises:

an alignment rod, where the alignment rod has a top portion, a bottom portion, and a length with an axis therethrough, and where the top portion of the alignment rod is pivotally attached with the body member;

a load rod in a fixed parallel alignment with the axis of the alignment rod, where the load rod has a top part and a bottom part, and where the load rod is connected with the alignment rod such that a length of the sliding rod is adjustable by sliding the top part of the load rod between the bottom portion and top portion of the alignment rod; and wherein the load pin is attached with the load road, whereby as a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

10. A passive exoskeleton as set forth in claim 9, wherein the body member is rigid, allowing the passive exoskeleton to transfer weight from the body member and through the passive exoskeleton to the ground surface.

11. A passive exoskeleton as set forth in claim 10, wherein the load rod further comprises an ankle joint attached with the bottom part of the load rod, where the ankle joint pivotally connects the load rod with the foot analog.

12. A passive exoskeleton as set forth in claim 11, wherein the rocker has a first side and a second side, and both the travel channel and the load channel are formed through the rocker from the first side to the second side.

13. A passive exoskeleton as set forth in claim 12, further comprising a front rocker stop and a rear rocker stop, the front rocker stop and the rear rocker stop being attached with the body member, and wherein the rocker further comprises a top component for engaging with both the front and rear rocker stops, formed such that when a user is walking, the rocker travels from a forward position to a rear position, and when the rocker is in a forward position, the top component engages with the rear rocker stop, and when the rocker is in a rear position, the top component engages with the front rocker stop.

14. A passive exoskeleton as set forth in claim 13, further comprising a foot connector attached with the foot analog, whereby a user may utilize the foot connector to securely attach the foot analog with the user's foot or shoe, thereby allowing the foot analog to maintain a position proximate the user's foot.

15. A passive exoskeleton as set forth in claim 14, further comprising a body attachment attached with the body member, the body attachment being selected from a group consisting of a flexible harness, a belt, and suspenders, where the body attachment is for attaching with a torso portion of a user, allowing the user to operate the exoskeleton and maintain the exoskeleton in a position proximate the user.

16. A passive exoskeleton as set forth in claim 15, further comprising a load frame attached with the body member, whereby a user may attach a load with the load frame and thereby transfer weight from the load, through the exoskeleton and to the ground surface.

17. A passive exoskeleton as set forth in claim 5, further comprising a foot connector attached with the foot analog, whereby a user may utilize the foot connector to securely attach the foot analog with the user's foot or shoe, thereby allowing the foot analog to maintain a position proximate the user's foot.

18. A passive exoskeleton as set forth in claim 3, wherein the sliding rod further comprises:

an alignment rod, where the alignment rod has a top portion, a bottom portion, and a length with an axis therethrough, and where the top portion of the alignment rod is pivotally attached with the body member;

a load rod in a fixed parallel alignment with the axis of the alignment rod, where the load rod has a top part and a bottom part, and where the load rod is connected with the alignment rod such that a length of the sliding rod is adjustable by sliding the top part of the load rod between the bottom portion and top portion of the alignment rod; and wherein the load pin is attached with the load road, whereby as a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

19. A passive exoskeleton as set forth in claim 18, wherein the load rod further comprises an ankle joint attached with the bottom part of the load rod, where the ankle joint is formed to pivotally connect the load rod with a foot analog.

20. A passive exoskeleton as set forth in claim 2, further comprising a front rocker stop and a rear rocker stop, the front rocker stop and the rear rocker stop being attached with the body member, and wherein the rocker further comprises a top component for engaging with both the front and rear rocker stops, formed such that when a user is walking, the rocker travels from a forward position to a rear position, and when the rocker is in a forward position, the top component engages with the rear rocker stop, and when the rocker is in a rear position, the top component engages with the front rocker stop.

21. A passive exoskeleton as set forth in claim 2, further comprising a body attachment attached with the body member, the body attachment being selected from a group consisting of a flexible harness, a belt, and suspenders, where the body attachment is for attaching with a torso portion of a user, allowing the user to operate the exoskeleton and maintain the exoskeleton in a position proximate the user.

22. A passive exoskeleton as set forth in claim 2, wherein the body member is rigid, allowing the passive exoskeleton to transfer weight from the body member and through the passive exoskeleton to the ground surface.

23. A passive exoskeleton as set forth in claim 1, further comprising a pressure mechanism attached with the bias block for forcing the bias block against the top component of the rocker, thereby aiding the bias block in turning the rocker after the top component of the rocker passes the point of equilibrium.

24. A passive exoskeleton as set forth in claim 23, wherein the pressure mechanism is selected from a group consisting of a spring and hydraulics.

25. A passive exoskeleton as set forth in claim 1, further comprising a neutral block attached with the passive exoskeleton, the neutral block formed in such a manner that it is engage-able with the rocker to prevent the rocker from moving, such that when engaged with the rocker and when the load pin is in the travel channel, the load pin is maintained in the travel channel and is unable to transfer to the load channel, thereby causing the user to bear the full weight of the load.

26. A passive exoskeleton as set forth in claim 1, wherein the rocker has a first side and a second side, and both the travel channel and the load channel are formed through the rocker from the first side to the second side.

27. A passive exoskeleton as set forth in claim 1, further comprising a load frame attached with the body member, whereby a user may attach a load with the load frame and thereby transfer weight from the load, through the exoskeleton and to the ground surface.

28. A kit for building a passive exoskeleton, the kit comprising:

a rocker for attaching with a body member, the rocker having a travel channel and a load channel incorporated therein, the travel channel being an elongated channel oriented directionally from proximate the body member to a ground surface, and the load channel formed as an elongated channel and positioned such that an angle between the load channel and the travel channel is less than ninety degrees, both the load channel and the travel channel formed to accommodate a load pin, the rocker also including a top component;

a bias block for attaching with the body member and for engaging with the top component of the rocker, both the bias block and the top component of the rocker are formed in such a manner that as a user walks and shifts between a swing phase and a stance phase, the top component of the rocker passes a point of equilibrium where the bias block turns the rocker to aid the load pin in transferring between the load channel and travel channel, thereby shifting the load from the rocker onto the load pin and ultimately to a ground surface, causing the passive exoskeleton to support at least a portion of the load.

29. A kit for building a passive exoskeleton as set forth in claim 28, further comprising a body member for attaching proximate a portion of a user's body, with the rocker pivotally attached with the body member.

30. A kit for building a passive exoskeleton as set forth in claim 29, further comprising a sliding rod attached with the body member.

31. A kit for building a passive exoskeleton as set forth in claim 30, further comprising a load pin attached with the sliding rod and operably attached with the rocker through both the travel channel and the load channel, formed such that as a user walks and shifts from a swing phase to a stance phase, the load is transferred from the body member to the rocker, the shift causing the load pin to travel between the travel channel and the load channel, with weight from the load being transferred from the load channel to the load pin and the sliding rod, and thereafter through the sliding rod and ultimately a ground surface, causing the passive exoskeleton to support at least a portion of the load.

32. A kit for building a passive exoskeleton as set forth in claim 31, further comprising a ground surface engage-able foot analog attached with the sliding rod, whereby weight from the load is transferred from the sliding rod to the foot analog and ultimately a ground surface, causing the passive exoskeleton to support at least a portion of the load.

33. A kit for building a passive exoskeleton as set forth in claim 32, further comprising a foot connector attached with the foot analog, whereby a user may utilize the foot connector to securely attach the foot analog with the user's foot or shoe, thereby allowing the foot analog to maintain a position proximate the user's foot.

34. A kit for building a passive exoskeleton as set forth in claim 30, wherein the sliding rod further comprises:

an alignment rod, where the alignment rod has a top portion, a bottom portion, and a length with an axis therethrough, and where the top portion of the alignment rod is pivotally attached with the body member;

a load rod in a fixed parallel alignment with the axis of the alignment rod, where the load rod has a top part and a bottom part, and where the load rod is connected with the alignment rod such that a length of the sliding rod is adjustable by sliding the top part of the load rod between the bottom portion and top portion of the alignment rod; and wherein the load pin is attached with the load road, whereby as a user walks and shifts from a swing phase to a stance phase, the load is transferred from the body member to the rocker, the shift causing the load pin to travel between the travel channel and the load channel, thereby shifting the load from the rocker onto the load pin and thereafter through the load rod and the foot analog to the ground surface.

35. A kit for building a passive exoskeleton as set forth in claim 34, wherein the load rod further comprises an ankle joint attached with the bottom part of the load rod, where the ankle joint is formed to pivotally connect the load rod with a foot analog.

36. A kit for building a passive exoskeleton as set forth in claim 29, further comprising a front rocker stop and a rear rocker stop, the front rocker stop and the rear rocker stop being attached with the body member, and wherein the rocker further comprises a top component for engaging with both the front and rear rocker stops, formed such that when a user is walking, the rocker travels from a forward position to a rear position, and when the rocker is in a forward position, the top component engages with the rear rocker stop, and when the rocker is in a rear position, the top component engages with the front rocker stop.

37. A kit for building a passive exoskeleton as set forth in claim 29, further comprising a body attachment attached with the body member, the body attachment being selected from a group consisting of a flexible harness, a belt, and suspenders, where the body attachment is for attaching with a torso portion of a user, allowing the user to operate the exoskeleton and maintain the exoskeleton in a position proximate the user.

38. A kit for building a passive exoskeleton as set forth in claim 29, wherein the body member is rigid, allowing the passive exoskeleton to transfer weight from the body member and through the passive exoskeleton to the ground surface.

39. A kit for building a passive exoskeleton as set forth in claim 28, further comprising a pressure mechanism attached with the bias block for forcing the bias block against the top component of the rocker, thereby aiding the bias block in turning the rocker after the top component of the rocker passes the point of equilibrium.

40. A kit for building a passive exoskeleton as set forth in claim 39, wherein the pressure mechanism is selected from a group consisting of a spring and hydraulics.

41. A kit for building a passive exoskeleton as set forth in claim 28, further comprising a neutral block attached with the passive exoskeleton, the neutral block formed in such a manner that it is engage-able with the rocker to prevent the rocker from moving, such that when engaged with the rocker and when the load pin is in the travel channel, the load pin is maintained in the travel channel and is unable to transfer to the load channel, thereby causing the user to bear the full weight of the load.

42. A kit for building a passive exoskeleton as set forth in claim 28, wherein the rocker has a first side and a second side, and both the travel channel and the load channel are formed through the rocker from the first side to the second side.

43. A kit for building a passive exoskeleton as set forth in claim 28, further comprising a load frame attached with the body member, whereby a user may attach a load with the load frame and thereby transfer weight from the load, through the exoskeleton and to the ground surface.

44. A method for forming a passive exoskeleton, the method comprising acts of:

forming a body member for attaching proximate a portion of a user's body;

attaching a sliding rod with the body member;

attaching a ground surface engage-able foot analog with the sliding rod;

pivotally attaching a rocker with the body member, the rocker having a travel channel and a load channel incorporated therein, the travel channel being an elongated channel oriented directionally from proximate the body member to the ground surface, and the load channel formed as an elongated channel and positioned such that an angle between the load channel and the travel channel is less than ninety degrees, the rocker also including a top component;

attaching a load pin with the sliding rod and operably attaching the load pin with the rocker through both the travel channel and the load channel, the load pin formed such that as a user walks and shifts from a swing phase to a stance phase, the load is transferred from the body member to the rocker with the shift causing the load pin to travel between the travel channel and the load channel;

attaching a bias block with the body member for engaging with the top component of the rocker, both the bias block and the top component of the rocker are formed in such a manner that as a user walks and shifts between the swing phase and stance phase, the top component of the rocker passes a point of equilibrium where the bias block turns the rocker to aid the load pin in transferring between the load channel and travel channel, thereby shifting the load from the rocker onto the sliding rod and thereafter through the sliding rod to the foot analog and ultimately a ground surface, causing the passive exoskeleton to support at least a portion of the load.

45. A method for forming a passive exoskeleton as set forth in claim 44, further comprising an act of attaching a pressure mechanism with the bias block for forcing the bias block against the top component of the rocker, thereby aiding the bias block in turning the rocker after the top component of the rocker passes the point of equilibrium.

46. A method for supporting a load, the method comprising an act of:

attaching a passive exoskeleton with a user's body, the passive exoskeleton comprising:

a body member for attaching proximate a portion of a user's body;

a sliding rod attached with the body member;

a ground surface engage-able foot analog attached with the sliding rod;

a rocker pivotally attached with the body member, the rocker having a travel channel and a load channel incorporated therein, the travel channel being an elongated channel oriented directionally from proximate the body member to the ground surface, and the load channel formed as an elongated channel and positioned such that an angle between the load channel and the travel channel is less than ninety degrees, the rocker also including a top component;

a load pin attached with the sliding rod and operably attached with the rocker through both the travel channel and the load channel, formed such that as a user walks and shifts from a swing phase to a stance phase, the load is transferred from the body member to the rocker, the shift causing the load pin to travel between the travel channel and the load channel;

a bias block attached with the body member for engaging with the top component of the rocker, both the bias block and the top component of the rocker are formed in such a manner that as a user walks and shifts between the swing phase and stance phase, the top component of the rocker passes a point of equilibrium where the bias block turns the rocker to aid the load pin in transferring between the load channel and travel channel, thereby shifting the load from the rocker onto the sliding rod and thereafter through the sliding rod to the foot analog and ultimately a ground surface, causing the passive exoskeleton to support at least a portion of the load.

* * * * *